US005819699A

United States Patent [19]

Burns

[11] Patent Number: 5,819,699

[45] Date of Patent: Oct. 13, 1998

[54] ROTARY INTERNAL COMBUSTION ENGINE

[76] Inventor: William A. Burns, 8029 Camden Way, Canfield, Ohio 44406

[21] Appl. No.: 854,913

[22] Filed: May 13, 1997

[51] Int. Cl.[6] ..... F02B 53/08

[52] U.S. Cl. ..... 123/234; 418/227

[58] Field of Search ..... 123/234, 236; 418/227

[56] References Cited

U.S. PATENT DOCUMENTS

| | | |
|---|---|---|
| 473,940 | 5/1892 | Mason . |
| 724,994 | 4/1903 | Cooley . |
| 1,831,263 | 11/1931 | Ross . |
| 2,136,066 | 11/1938 | Walters . |
| 2,181,962 | 12/1939 | Booth . |
| 2,880,045 | 3/1959 | Wankel . |
| 2,919,062 | 12/1959 | Tryhorn . |
| 2,988,065 | 6/1961 | Wankel . |
| 3,363,606 | 1/1968 | Robertson . |
| 3,636,930 | 1/1972 | Okada . |

FOREIGN PATENT DOCUMENTS

| | | | |
|---|---|---|---|
| 561617 | 8/1923 | France | 123/234 |

OTHER PUBLICATIONS

Chinitz, Wallace *Rotary Engines* Scientific American Magazine, Feb. 1969.

*Primary Examiner*—Michael Koczo

[57] ABSTRACT

An improved rotary combustion engine is provided with a cylindrical intake and compression housing and a cylindrical combustion and exhaust housing. Each of the housings contain variable volume spaces defined by the inner surface of elliptically shaped openings in the housings, the outer surface of a rotor within the opening, fusiform shaped pistons and end walls perpendicular to the common axis of the cylinder and the rotor. The stages are coaxial and separated by a disk valve. The rotors within each housing are attached to the engine shaft. The pistons are supported in bearings mounted in end plates which are attached to the rotors. The attitude of the pistons is controlled during engine rotation by cams at each end of the engine. A mixture of fuel and air is drawn through one of two ports into variable volume spaces in the intake and compression housing by the relative motion of rotor and pistons. Further rotation seals the spaces and compresses the mixture. Continued engine rotation causes transfer of the compressed mixture into variable volume spaces in the combustion and exhaust housing where it is ignited. Ignition of the mixture forces the pistons in the combustion housing to orbit the engine shaft and rotational force is transmitted through end plates and the combustion rotor to the shaft. Continuing rotation of the engine forces exhaust gases to be expelled through two ports in the combustion and exhaust stage.

8 Claims, 23 Drawing Sheets

Vertical longitudinal cross section horizontal longitudinal cross section

Cross section
of compression stage

Cross sectional
view of combustion stage

End of compression and start of charge transfer

End of charge transfer

Start of charge transfer

End of charge transfer

Piston assembly

View in Circle A of Fig. 5 alternate embodiment of engine

Engine Side view

ROTARY INTERNAL COMBUSTION ENGINE

BACKGROUND—FIELD OF INVENTION

This invention relates to internal combustion engines of the rotary type.

BACKGROUND—DESCRIPTION OF PRIOR ART

This invention is an improvement on internal combustion engines that combine the beneficial characteristics of positive displacement piston engines with those of vane type type turbine engines while avoiding their inherent limitations. My engine utilizes only rotary motion and avoids the use of any reciprocating components or cranks that require the application of force to the engine shaft at an inefficient angle. In addition, my engine utilizes the intermittent combustion of a compressed air-fuel mixture in sealed variable volumes spaces. Intermittent combustion allows the use of higher peak temperatures which tend to increase thermodynamic efficiency. The peak temperatures used in turbine engines is limited by the physical properties of engine components that are exposed to continuous combustion.

Many rotary internal combustion engines have been devised. Some employ pairs of pistons that alternately approach and recede from each other during compression and combustion. In engines of this type shock loads on engine components often cause failure.

Other rotary engines employ components that rotate about axes parallel but eccentric to the axis of the engine output shaft. These engines require counterweights to balance eccentric components thereby increasing the ratio of engine weight to power output.

Other rotary engines are based on simple rotary motion of two or more rotors. These engines do not have a compression phase in their operating cycle and, consequently, are relatively low in efficiency. Sealing between rotors is also a problem.

My engine successfully employs components that move from sealed contact with one surface to sealed contact with another surface contrary to previously held beliefs by experts in the field.

In some rotary engines the entire engine block is rotated by the force on pistons or variable volume combustion chambers which use rollers and cams to provide rotary motion. High stress on components and sealing problems have limited the use of these engines.

Other rotary engines with piston, rotor and variable volume chambers similar to my invention attempt to accomplish intake, compression, combustion and exhaust in a single stage. Engines of this type cannot produce efficient compression ratios and are subject to excessive loss of pressure and leakage between stages.

OBJECTS AND ADVANTAGES

Therefore, it is a primary object of the present invention to provide a new and useful rotary engine not subject to the disadvantages enumerated above and having a new and useful rotary configuration designed for operating the engine safely, efficiently and economically.

Another object of the present invention is to provide an engine whose components move with pure rotational motion and accelerate and decelerate smoothly as engine speed is changed.

Another object is to provide an engine with an improved power to weight ratio.

Another object is to provide an engine that is simple to manufacture. Other objects will become apparent from the following description.

REFERENCE NUMERALS IN DRAWINGS

Figure 1:
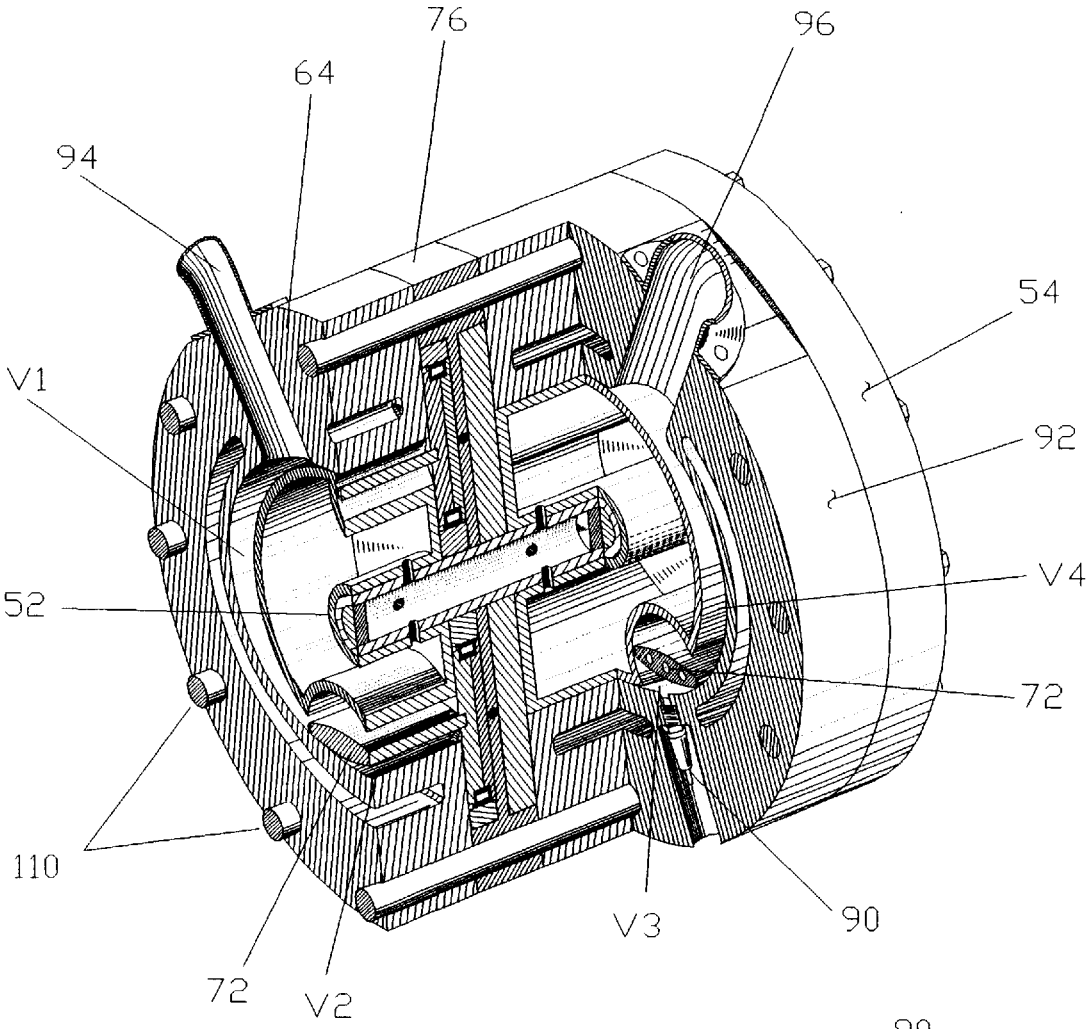
FIG. 1 Partial perspective view and partial section of engine stages

50 carburetor
52 shaft

53 plug
54 end plate—housing
56 plate—outer piston bearing
58 cam follower
60 end plate—outer rotor
62 compression rotor
63 combustion rotor
64 compression housing
65 compression housing—alternate shape
66 slot—housing to rotor seal
68 end plate—inner rotor
72 piston
73 piston—alternate shape
74 plate—inner piston bearing
76 valve disk
77 disk valve passage
78 seal—housing to rotor
80 slip joint leaf—housing to rotor seal
82 seal—housing to rotor end
84 seal—housing end
86 strip—housing end seal
90 spark plug
92 combustion housing
93 combustion housing—alternate shape
94 intake manifold
96 exhaust manifold
98 seal—outer transfer port ring
100 seal—inner transfer port ring
102 seal—piston ring
108 cap—piston bearing plate
110 bolt
114 seal—piston longitudinal strip
118 bearing—main roller
119 bearing—piston roller
130 port—piston transfer
134 shaft cooling fluid ports
135 bearing—main ball
136 bearing—piston ball
138 compression housing cooling fluid passage
139 combustion housing cooling fluid passage
140 cam groove
141 port—intake
142 port—exhaust
146 bolt—piston
148 bolt—piston bearing cap
150 ring—bearing retainer
154 end plate gear
156 intermediate gear
158 piston gear
D Displacement angle
V1 variable volume chamber—connected to intake port
V2 variable volume chamber—compression
V3 variable volume chamber—combustion
V4 variable volume chamber—connected to exhaust port
X added clearance volume
Y clearance volume

DESCRIPTION OF THE INVENTION—FIGS. 1 to 27

Components with the same numerical designation are physically identical.

Figure 1A:
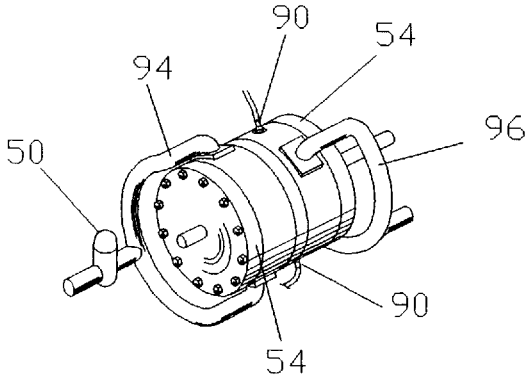
FIG. 1*a* Perspective view of engine

FIGS. 1 and 1*a* show a typical embodiment of the engine in which a carburetor 50 is connected to an intake manifold 94 which is attached at two places to the compression housing 64. The exhaust manifold 96 is attached in two places to the combustion housing 92. Housing end plates 54, compression housing 64, valve disk 76 and combustion housing 92 are fastened together by longitudinal tie bolts 110 and dowel pins (not shown). Two spark plugs 90 are located diametrically opposite each other in the combustion housing 92. The external housing of the invention comprising the housing end plates 54, the compression housing 64, the valve disk 76 and combustion housing 92 is supported by means not shown. The shaft 52 is concentric with the outer diameters of the end plates, extends through them and rotates relative to the external housing. The shaft is supported by bearings 135 and 118 (FIG. 2).

Figure 15:
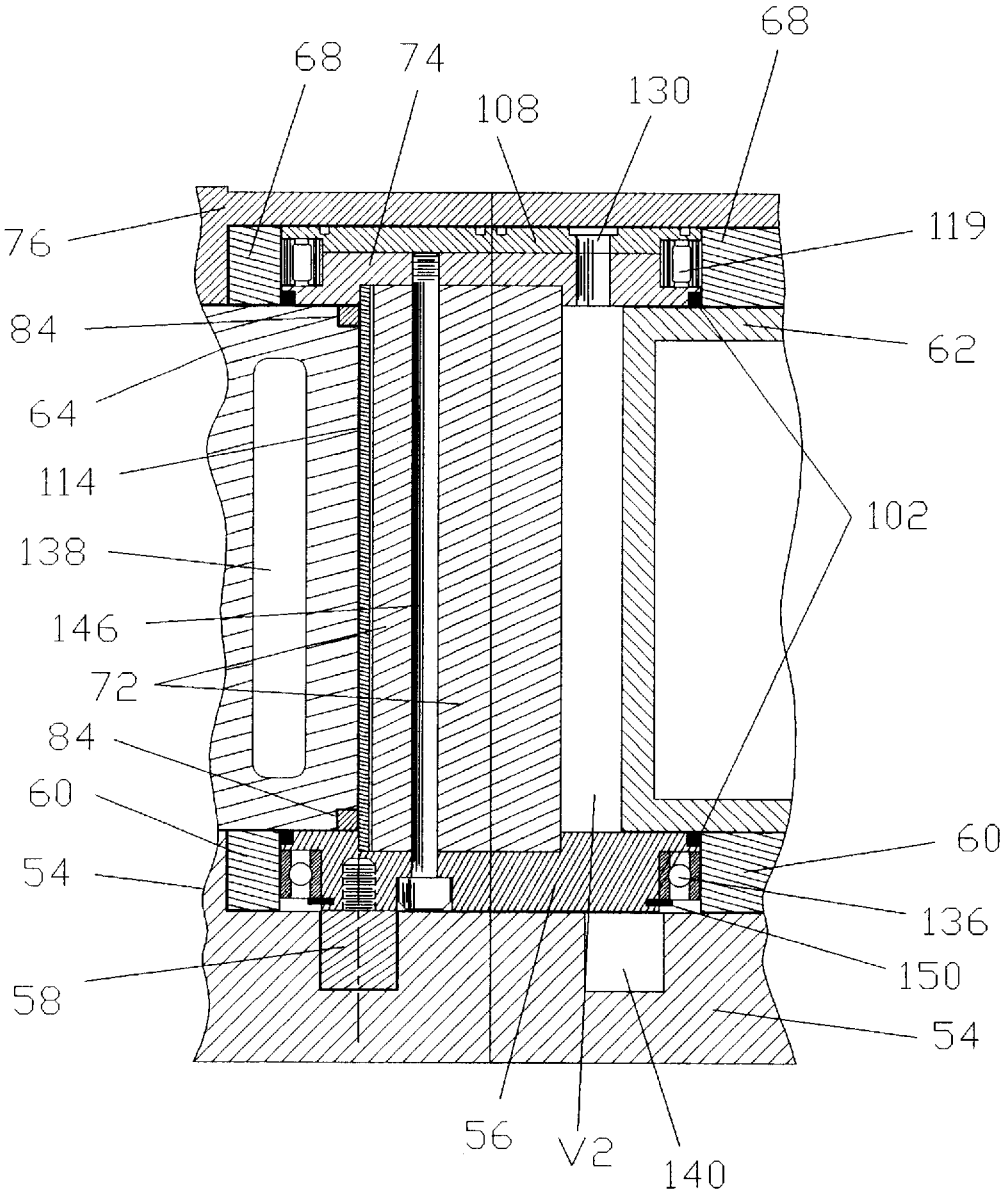
Figure 16:
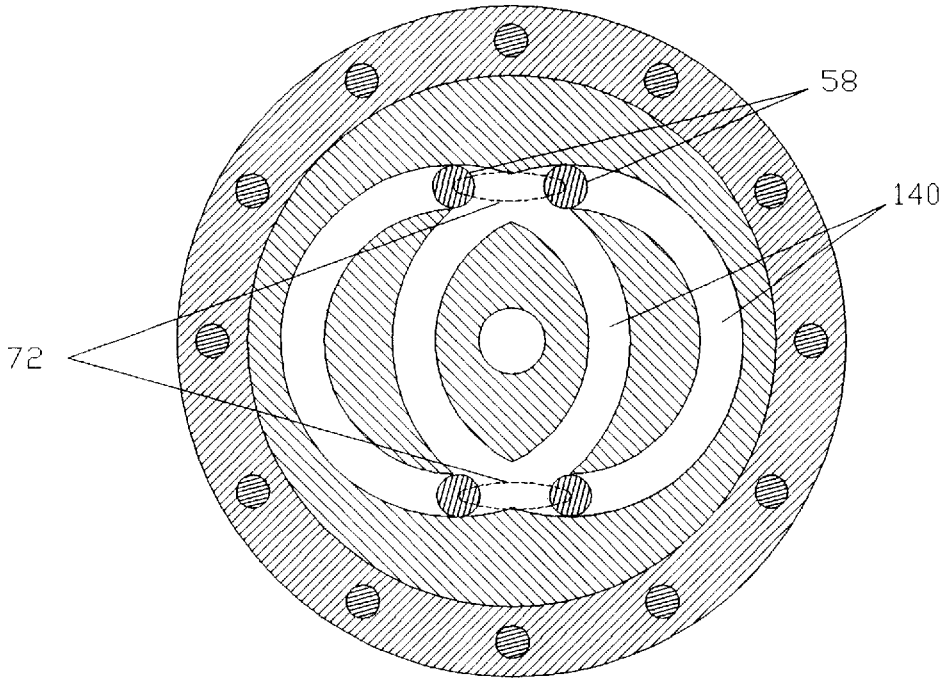
FIG. 16 Cross sectional view of cams and cam followers taken on line 16—16 of FIG. 2
Figure 17:
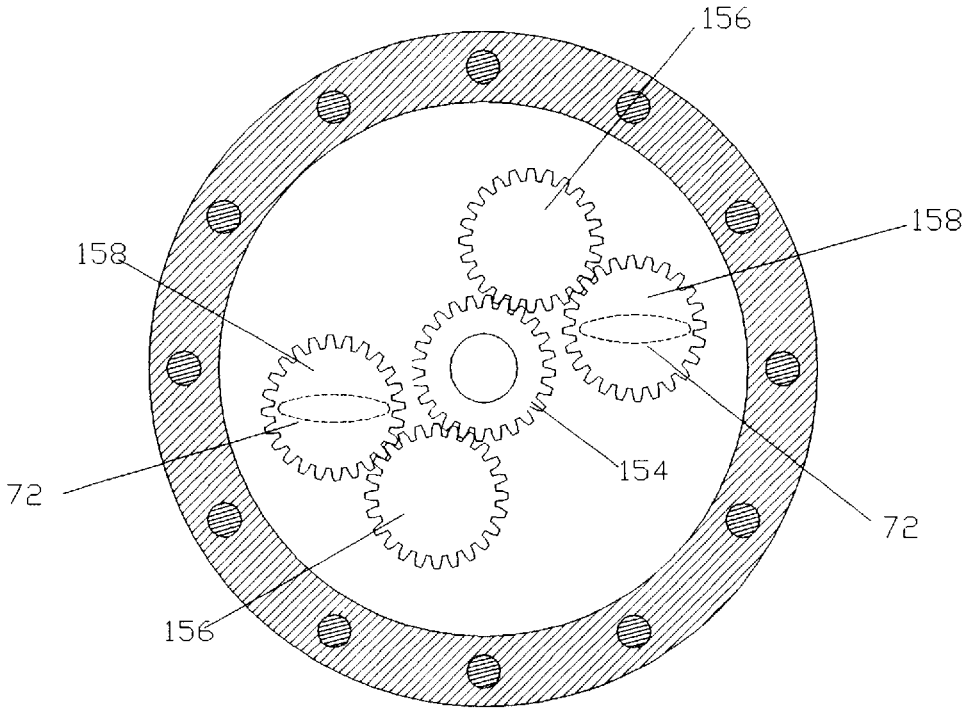
FIG. 17 Piston gear arrangement
Figure 18:
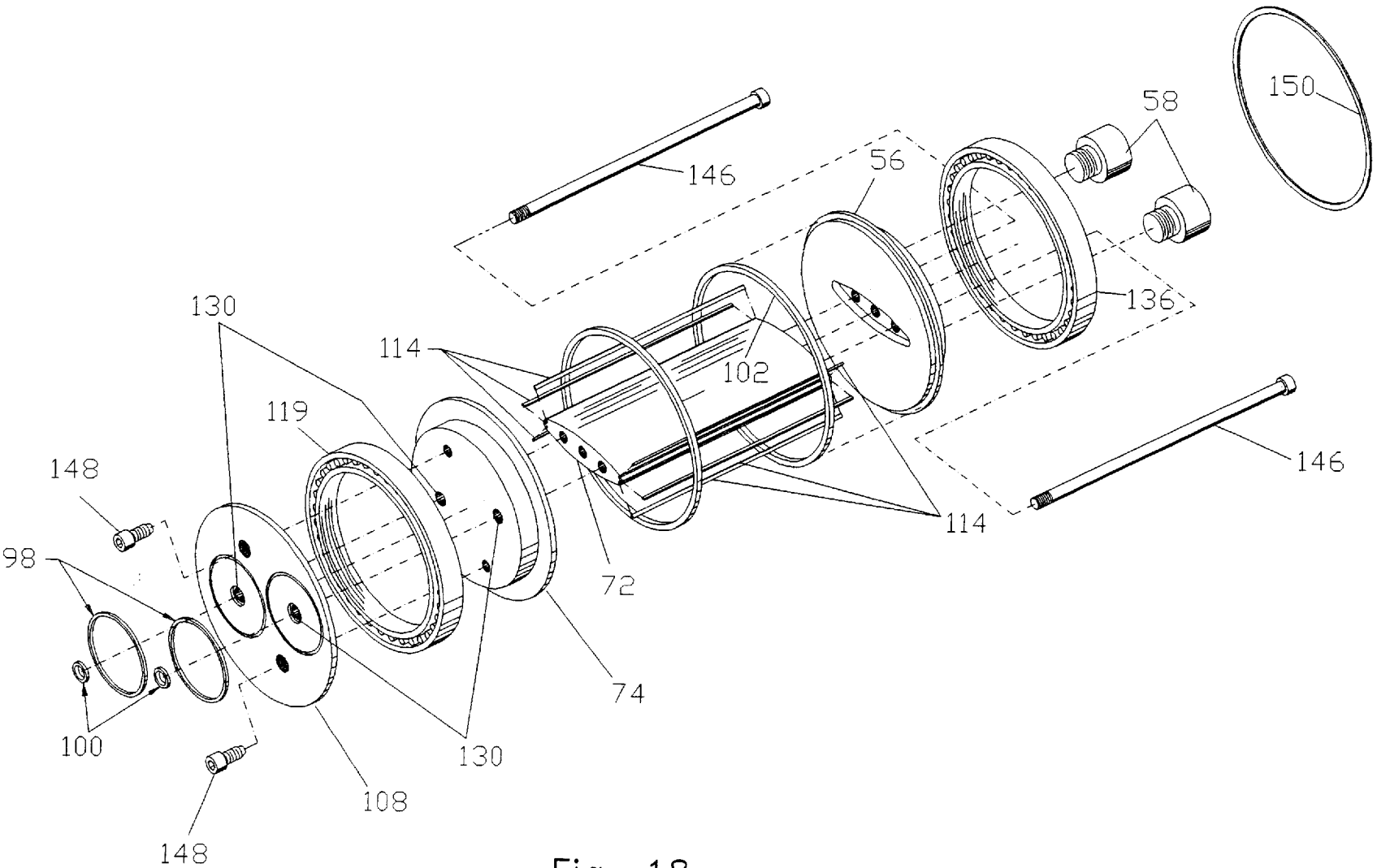
FIG. 18 Exploded view of piston assembly

The inner cavity of the compression housing 64 (FIG. 4) is uniformly elliptical in cross section through its length with the elements of the ellipse parallel to the axis of the housing. Intake ports 141 shown in FIGS. 4 and 6 connect to variable volume chambers V1. Variable volume chambers V1 and V2 are formed by the inner walls of the compression housing 64, the outer surfaces of compression rotor 62 which is generally cylindrical in shape, a pair of orbiting pistons 72, an outer rotor end plate 60, an inner rotor end plate 68 (FIGS. 2 & 3) an outer piston bearing plate 56 and an inner piston bearing plate 74 (FIGS. 2 & 18). Variable volume chambers V1 differ from variable volume chambers V2 in that chambers V1 are in communication with intake ports 141 and chambers V2 are sealed. Exhaust ports 142 (FIGS. 5 & 6) connect to variable volume chambers V4. Variable volume chambers V3 and V4 (FIGS. 5 through 10) are formed by the inner walls of combustion housing 92, the outer surfaces of combustion rotor 63, pistons 72, rotor end plates 68 and 60 and piston bearing plates 56 and 74. Variable volume chambers V3 differ from variable volume chambers V4 in that chambers V3 are sealed and chambers V4 are in communication with exhaust ports 142. Pistons 72 are fusiform in cross section and are supported at their ends by piston bearing plates 56 at the outer ends of the pistons and piston bearing plates 74 (FIG. 18) at the ends of the pistons nearest the valve disk 76. The piston bearing plates 56 are supported by bearings 136 (FIGS. 2 & 18). Piston bearing plates 74 are supported by bearings 119. Piston bearing plates 74 are attached to piston bearing plate caps 108 with bolts 148 as shown in FIG. 18. Bearings 136 are mounted in outer rotor end plates 60 (FIGS. 2 & 3). Bearings 119 are mounted in rotor inner end plates 68 and held in place by bearing retainer rings 150 as shown in FIGS. 15 & 18. Two cam followers 58 (FIGS. 2, 17 & 18) are attached to each piston bearing plate 56. The cam followers engage the cam grooves 140 of engine end plates 54 (FIGS. 2, 3, 16 & 18). Instead of cams and cam grooves, an alternate form of the engine utilizes fixed gears 154 attached to end plates 54, freely rotating intermediate gears 156 attached to plates 60 and piston gears 158 fixed to bearing plates 56 (FIG. 17). Piston bolts 146 (FIGS. 15 & 18) and dowels not shown fasten piston assembly components together. Bearing retainer rings 150 (FIG. 18) are seated in end plates 60 as shown in FIG. 15.

Figure 6:
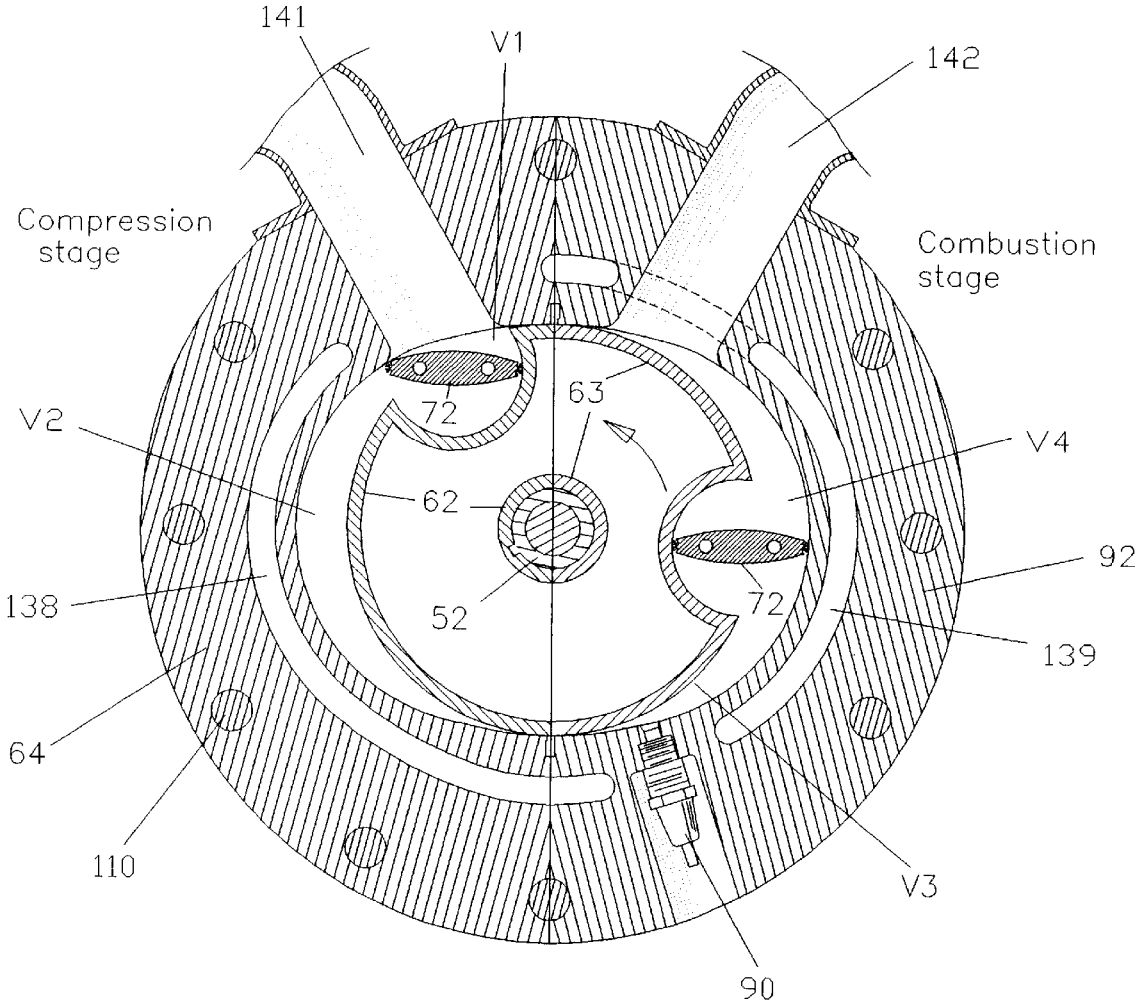
FIGS. 6 through 10 Cross sectional views taken at line 6—6 of FIG. 3 showing through 10 simultaneous positions of compression and combustion pistons at various points of engine rotation FIG. 11 Cross sectional view taken on line 11—11 of FIG. 3 showing one pair of pistons at start of transfers FIG. 12 Cross sectional view taken of line 12—12 of FIG. 11 showing transfer path FIG. 13 Cross sectional view taken on line 11—11 of FIG. 3 showing one pair of pistons at end of transfer FIG. 14 Cross sectional view taken on line 14—14 of FIG. 13 showing transfer path FIG. 15 Cross sectional view of piston taken on line 15—15 of FIG. 7
Figure 9:
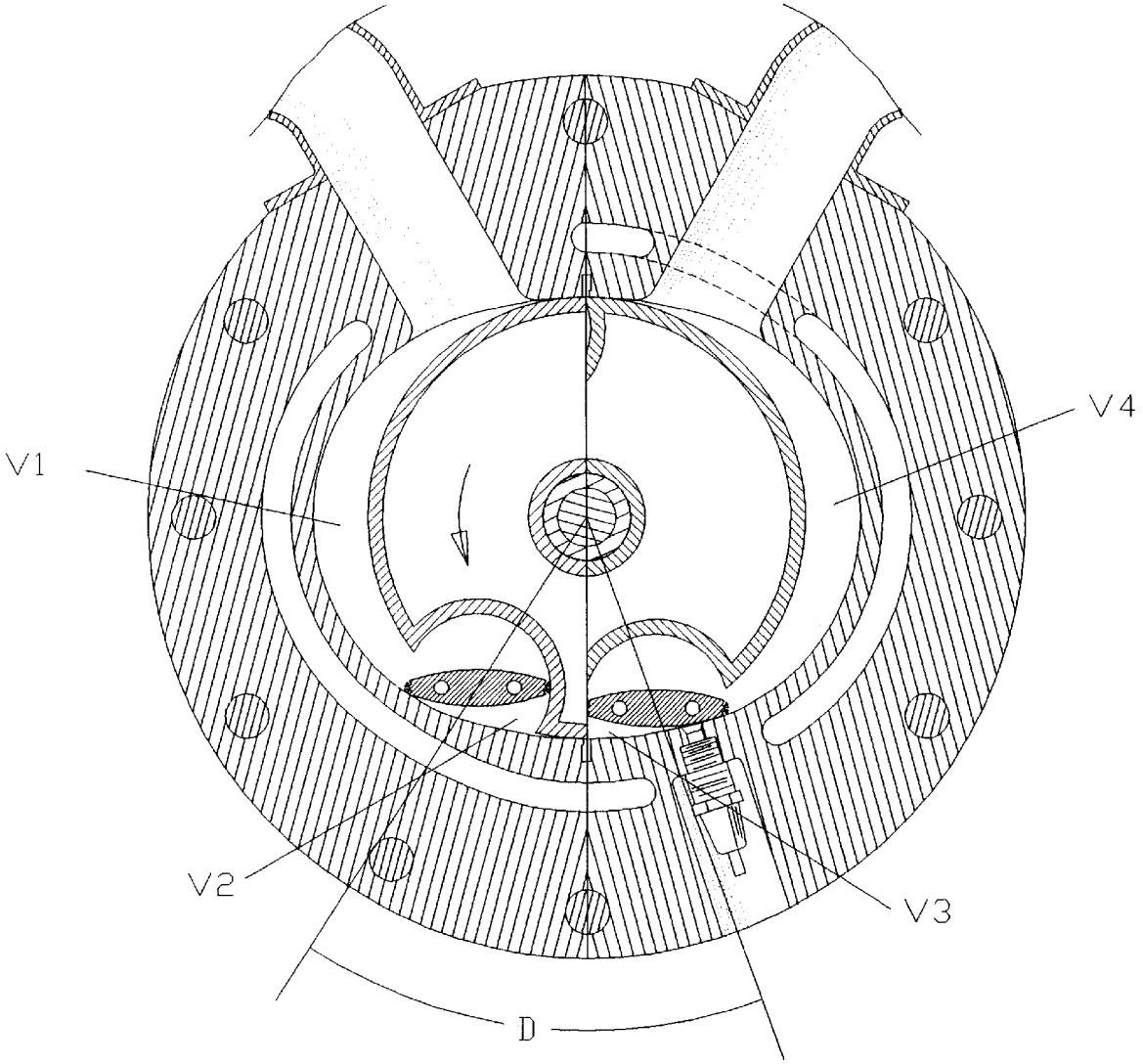

Rotors 62 and 63 are fixed to shaft 52 but the compression rotor 62 is angularly displaced with respect to the combustion rotor 63 (FIG. 9). Both rotors have a plate 60 and a plate 68 attached to them. The centers of bearings 119 and 136 mounted in rotor end plates 68 and 60 are coaxial with the centers of the pistons 72 and the centers of cylindrically shaped recesses in rotors 62 and 63 that accommodate the pistons during rotation (FIGS. 1 & 6).

Figure 2:
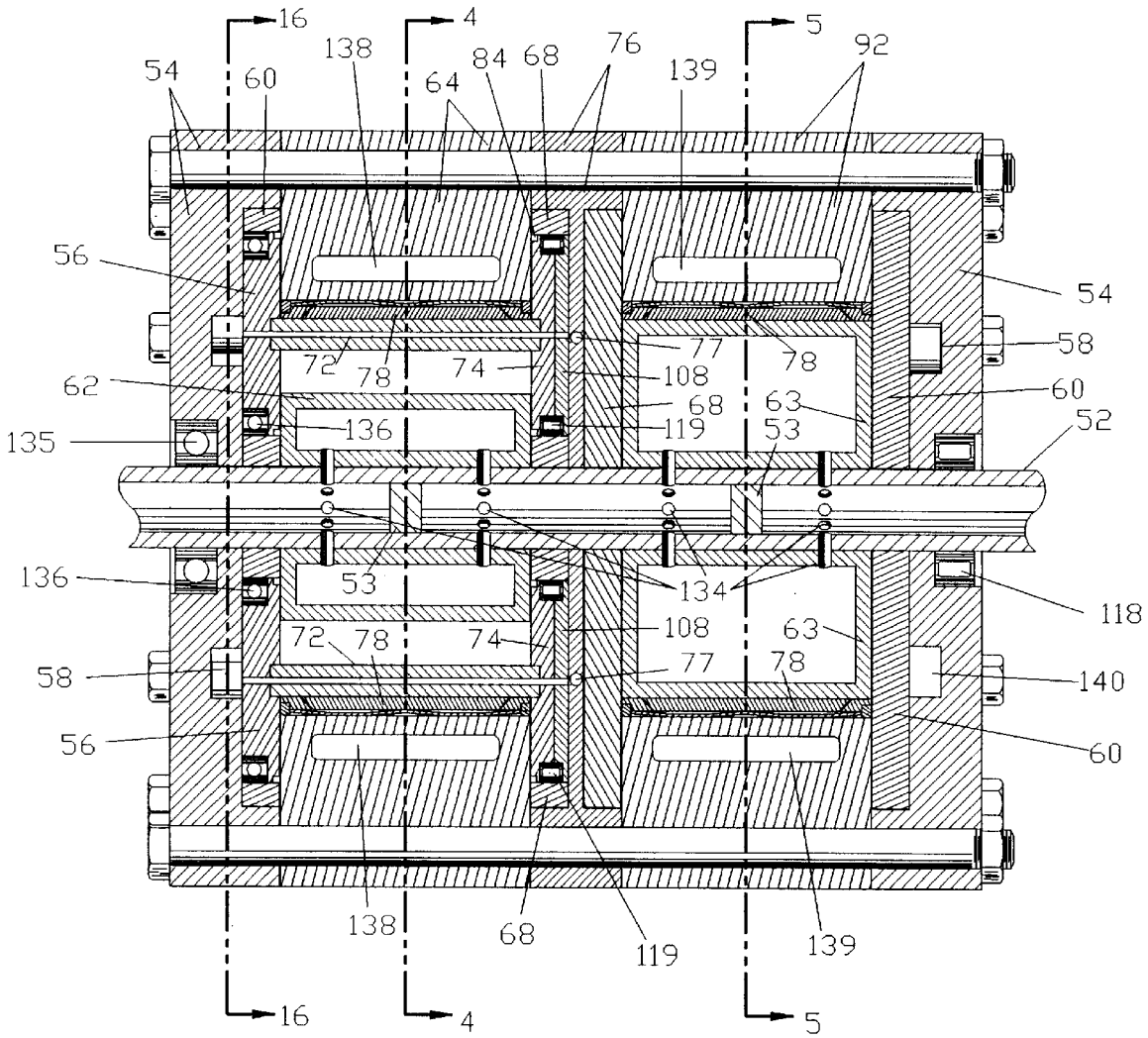
FIG. 2 Longitudinal cross sectional view taken through line 2—2 of FIG. 4
Figure 3:
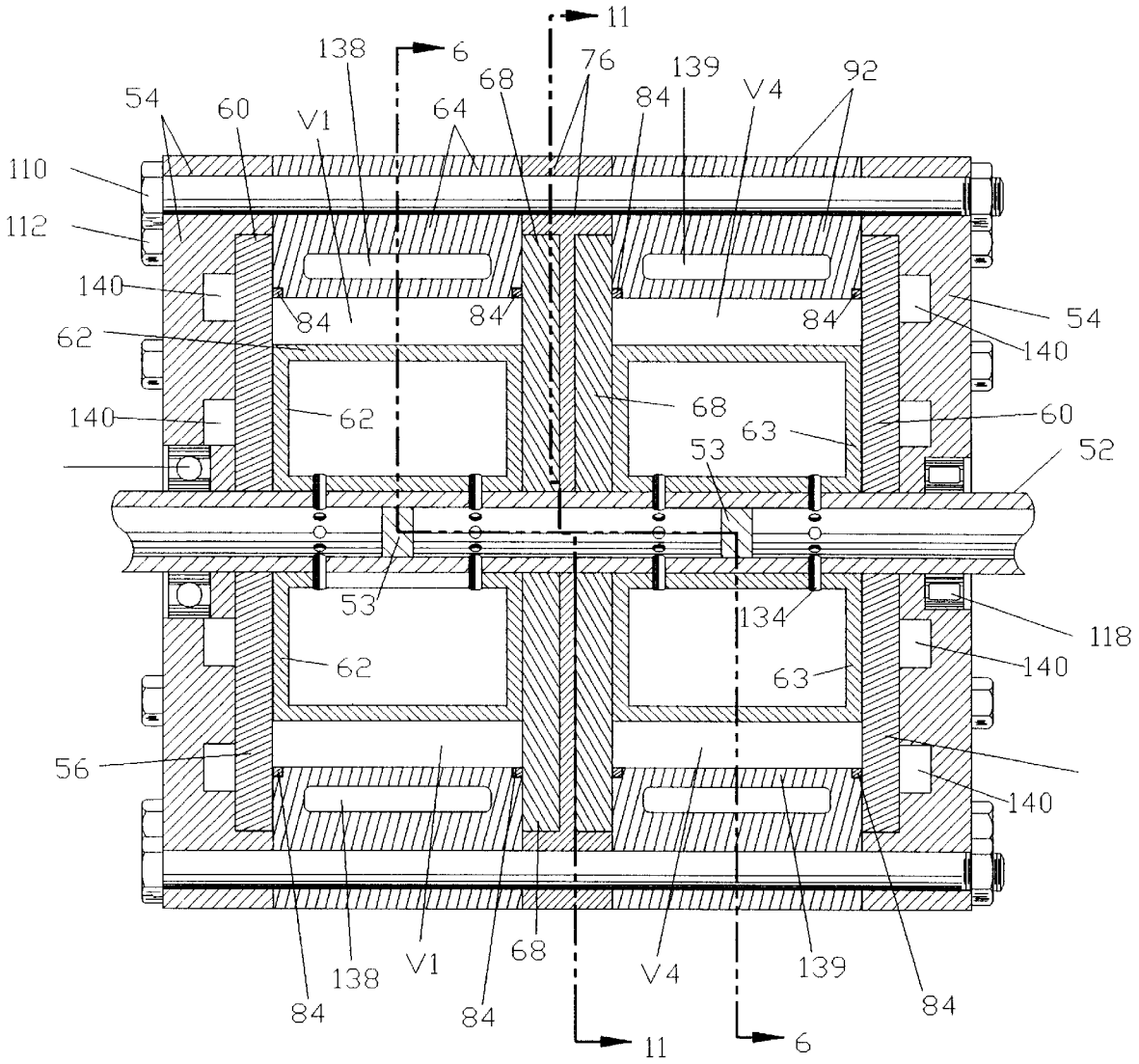
FIG. 3 Longitudinal cross sectional view taken through line 3—3 of FIG. 4
Figure 19:
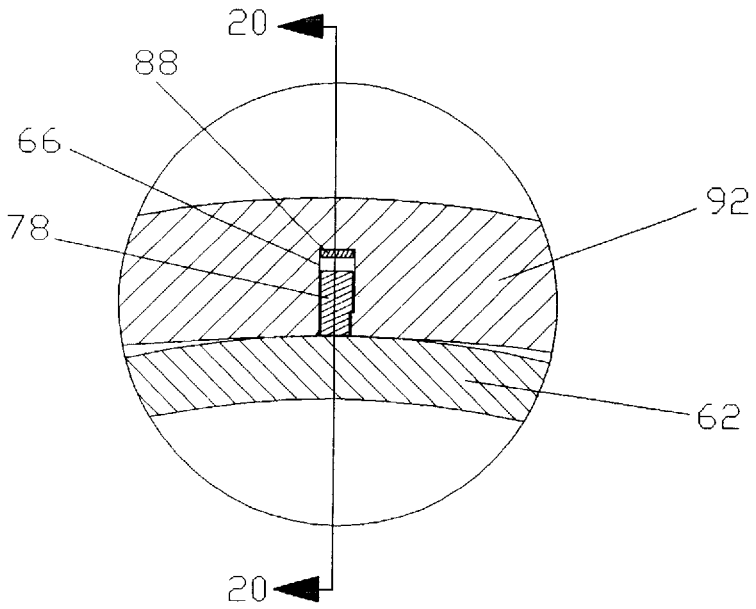
FIG. 19 An enlarged cross sectional view of rotor to housing seal shown in circle A of FIG. 5
Figure 20:
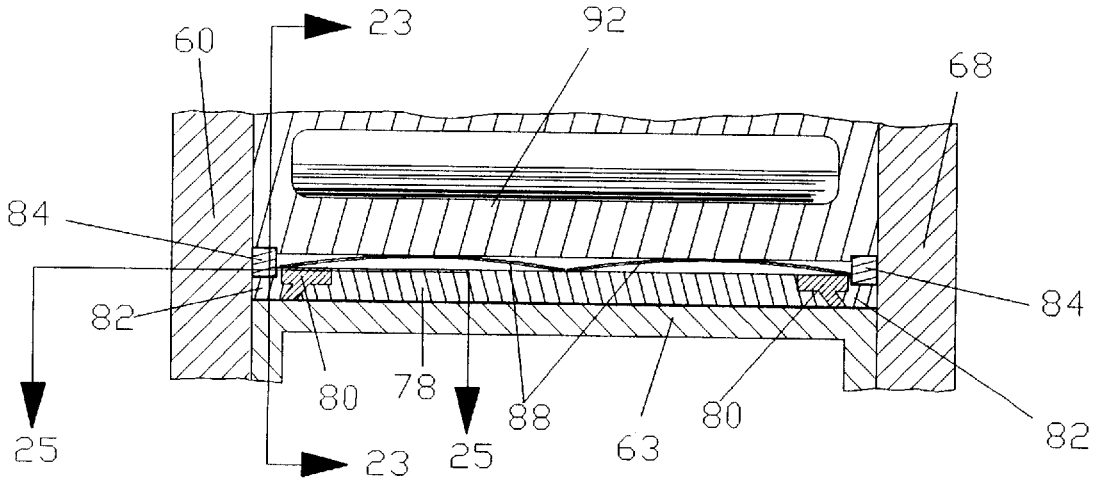
FIG. 20 Cross sectional view of rotor to housing seal taken through line 20—20 of FIG. 19
Figure 21:
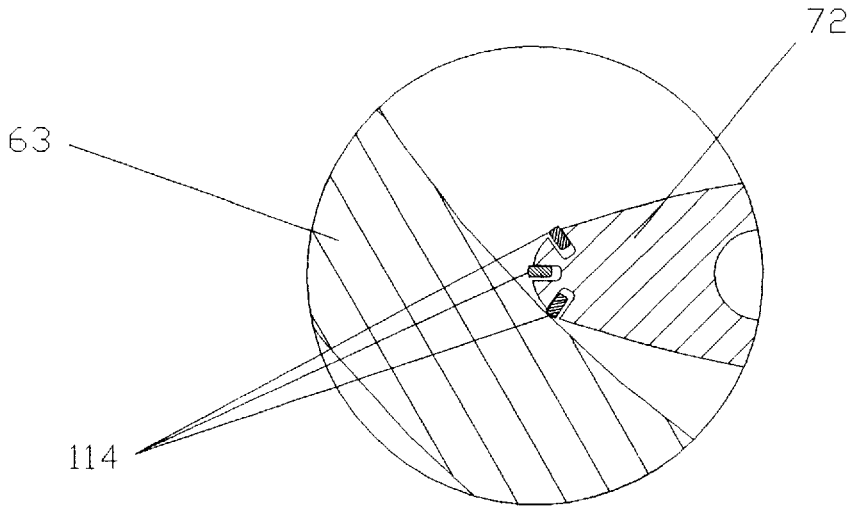
FIG. 21 Enlarged view of circle B in FIG. 5 showing piston edge seals
Figure 22:
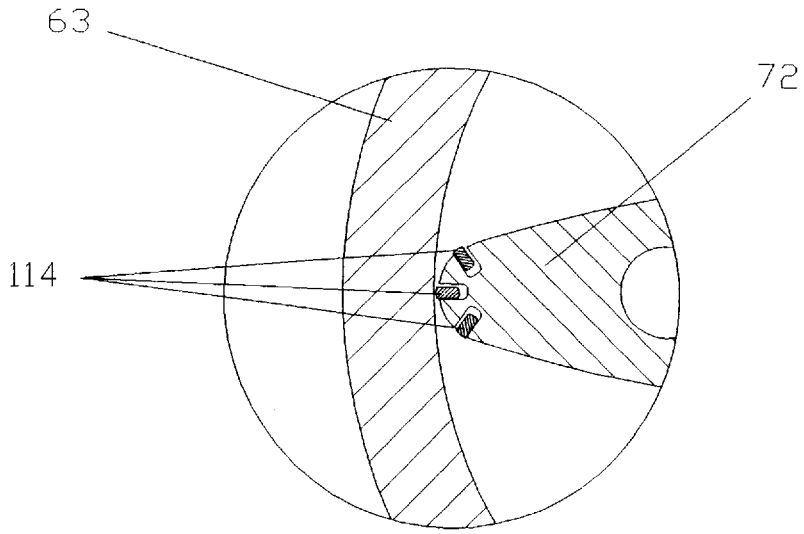
FIG. 22 Enlarged view of circle C in FIG. 5 showing piston edge seals

Housing to rotor seals 78 are located in slots 66 in compression housing 64 and combustion housing 92 (FIGS. 2 and 19). Housing to rotor seals 78 are stepped in cross section as are the slots 66. The steps retain the seals in the grooves. Housing to rotor seal springs 88 are located between the seals 78 and the bottom of the grooves as shown in FIG. 20.

Valve disk 76 contains two passages 77 that pass obliquely through the disk. During a portion of each engine revolution ports 130 passing through piston bearing plates 74 and piston bearing caps 108 (FIGS. 7, 11, 12, 13, 14, 15 & 18) connect with one end of the passages 77. Consequently, for a portion of each engine revolution, each of the variable volume chambers V2 is connected to a corresponding variable volume chamber V3 by one of two passages comprising ports 130 and passage 77.

Figure 23:
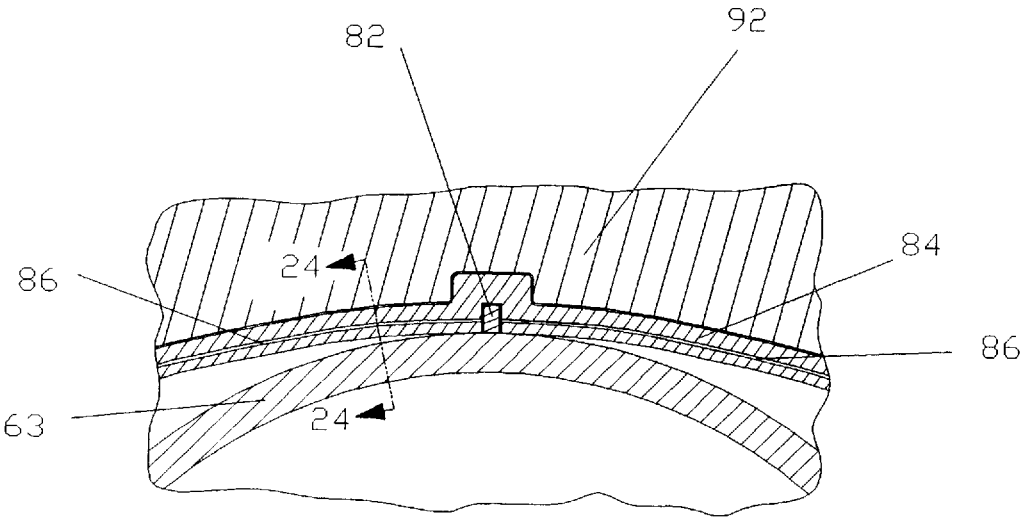
FIG. 23 Cross sectional view of housing end seal taken through line 23—23 of FIG. 20
Figure 24:
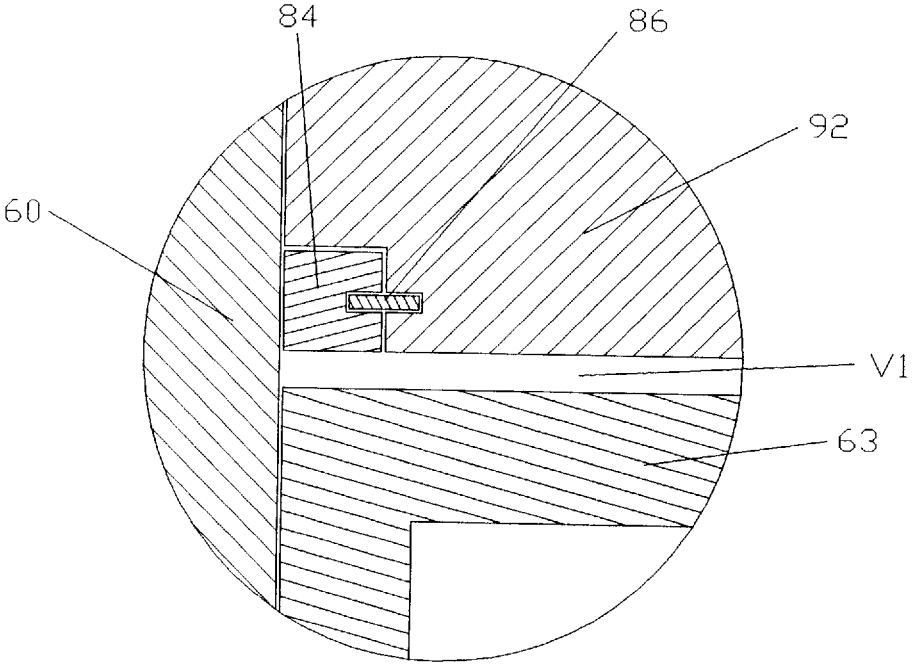
FIG. 24 Cross sectional view of housing end seal taken through line 24—24 of FIG. 23
Figure 25:
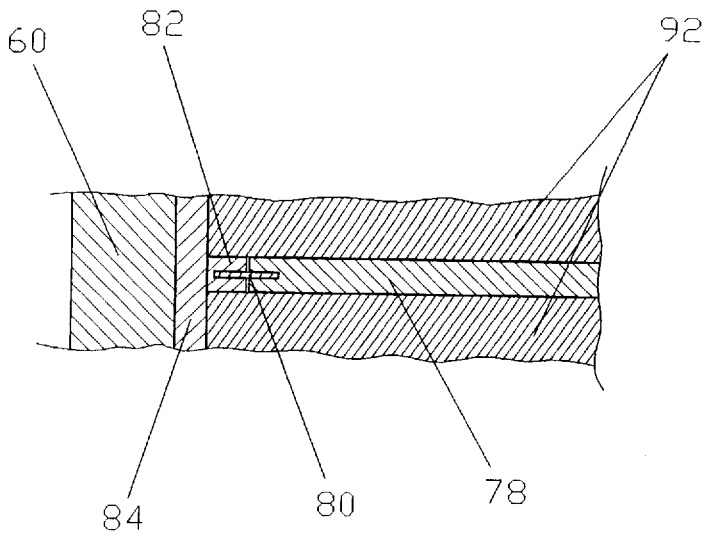
FIG. 25 Cross sectional view taken through line 25—25 of FIG. 20

Seal rings 98 and 100 (FIGS. 12 and 18) are seated in grooves in piston bearing caps 108 concentric with ports 130. Seal strips 114 are recessed in grooves in the pistons and held in place at their ends which extend into recesses in piston bearing plates 56 and 74 that accommodate the piston ends (FIGS. 5, 7, 15, 18, 21 and 22). Housing end seals 84 are located in recesses at each end of the compression housing 64 and the combustion housing 92 (FIGS. 5, 19, 20, 23, 24 and 26). Housing end seal strips 86 are located in corresponding grooves in housing end seal 84 and housings 64 and 92. Housing to rotor end seals 82 are held in place by notches in housing end seals 84 (FIGS. 20 & 23). Housing to rotor slip joint seals 80 (FIGS. 20, 25 & 26) are retained in position by slots in housing to rotor seals 78 and 82. Piston ring seals 102 (FIGS. 15 and 18) are recessed into bearing caps 56 and 74.

Coolant ports 134 connect the interior of shaft 52 with the cavities in rotors 62. Shaft plugs 53 are located as shown in FIGS. 2 & 3. Coolant passages 138 and 139 are located in compression chamber housing 64 and compression chamber housing 92, respectively, (FIGS. 2 & 3).

Figure 27:
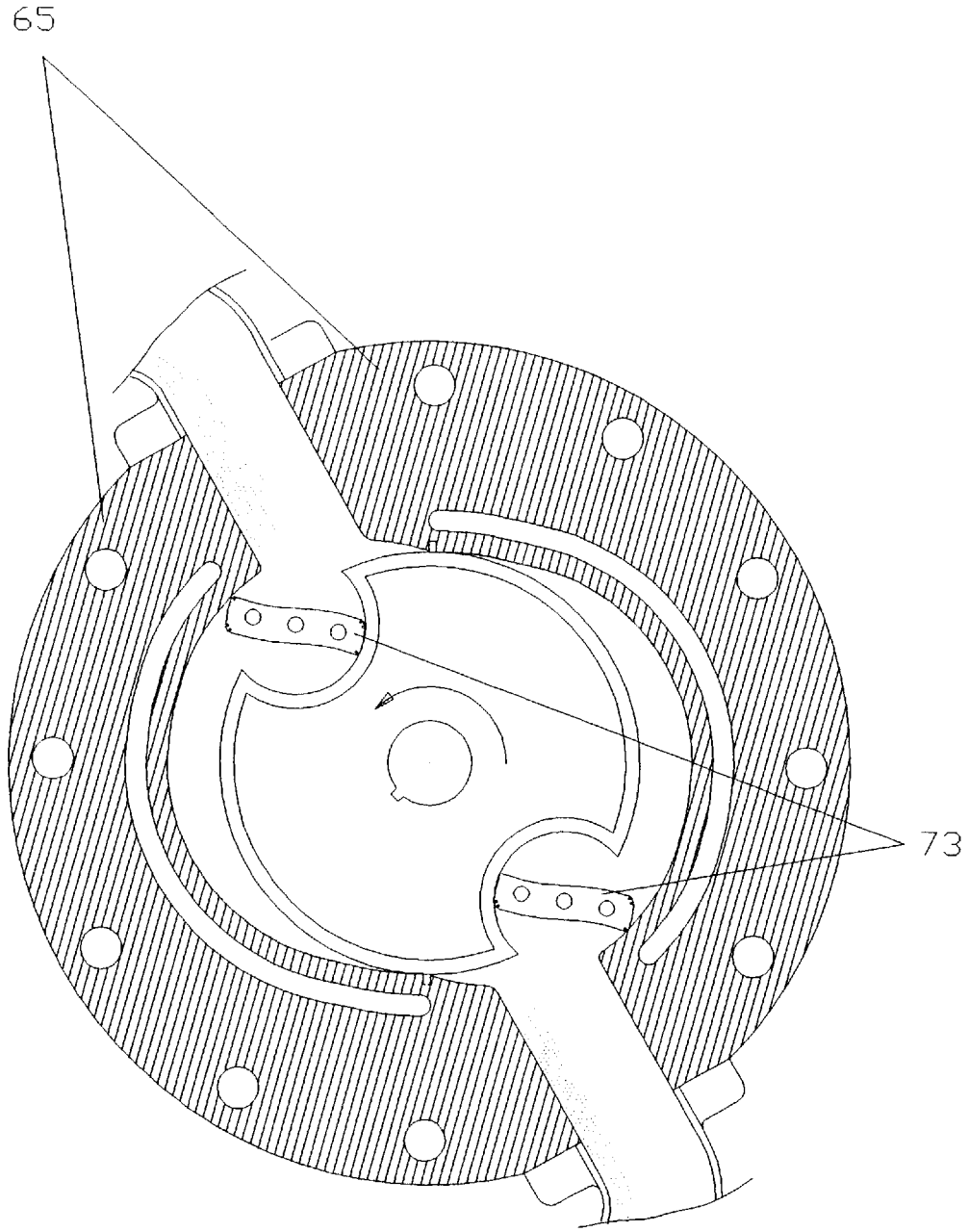
FIG. 27 Cross sectional view of alternate shaped chamber and piston configuration FIG. 28 Simplified cross section showing reduction of clearance volume with alternate shaped piston FIG. 29 Engine side view showing how compression chamber can be longer than combustion chamber FIG. 30 Illustration of multiple piston configuration

FIG. 27 taken through line 4—4 of FIG. 2 shows a cross sectional view of an alternate design of the engine using pistons 73 that are approximately rectangular in cross section and compression and combustion housings 65 and 93, respectively, that are modified from an elliptical cross section to a cross section designed to maintain sealed contact with pistons 73.

OPERATION OF INVENTION—FIGS. 1 to 30

The present invention operates as an internal combustion engine with distinct cycles of intake, compression, combustion and exhaust. In the operation of the engine rotor 62 rotates (FIGS. 4 and 6 through 10) creating a partial vacuum in variable volume chambers V1 causing air to be drawn into carburetor 50. The air passing through the carburetor mixes with fuel and the resulting air-fuel mixture enters intake manifold 94 and passes through intake ports 141 into variable volume chambers V1. In an alternative embodiment of the invention not shown fuel is injected directly into chambers V1 and a carburetor is not used. As the rotors rotate the attitude of the pistons 72 is kept constant and they are prevented from rotating about their own axes by the action of cam followers 58 engaged in cam grooves 140 (FIGS. 2 & 16). In an alternate embodiment of the invention the same motion of the pistons is achieved through the use of gears 154 attached to end plates 54, freely rotating intermediate gears 156 attached to rotor end plates 60 and gears 158 attached to bearing plates 56 as shown in FIG. 17.

Figure 4:
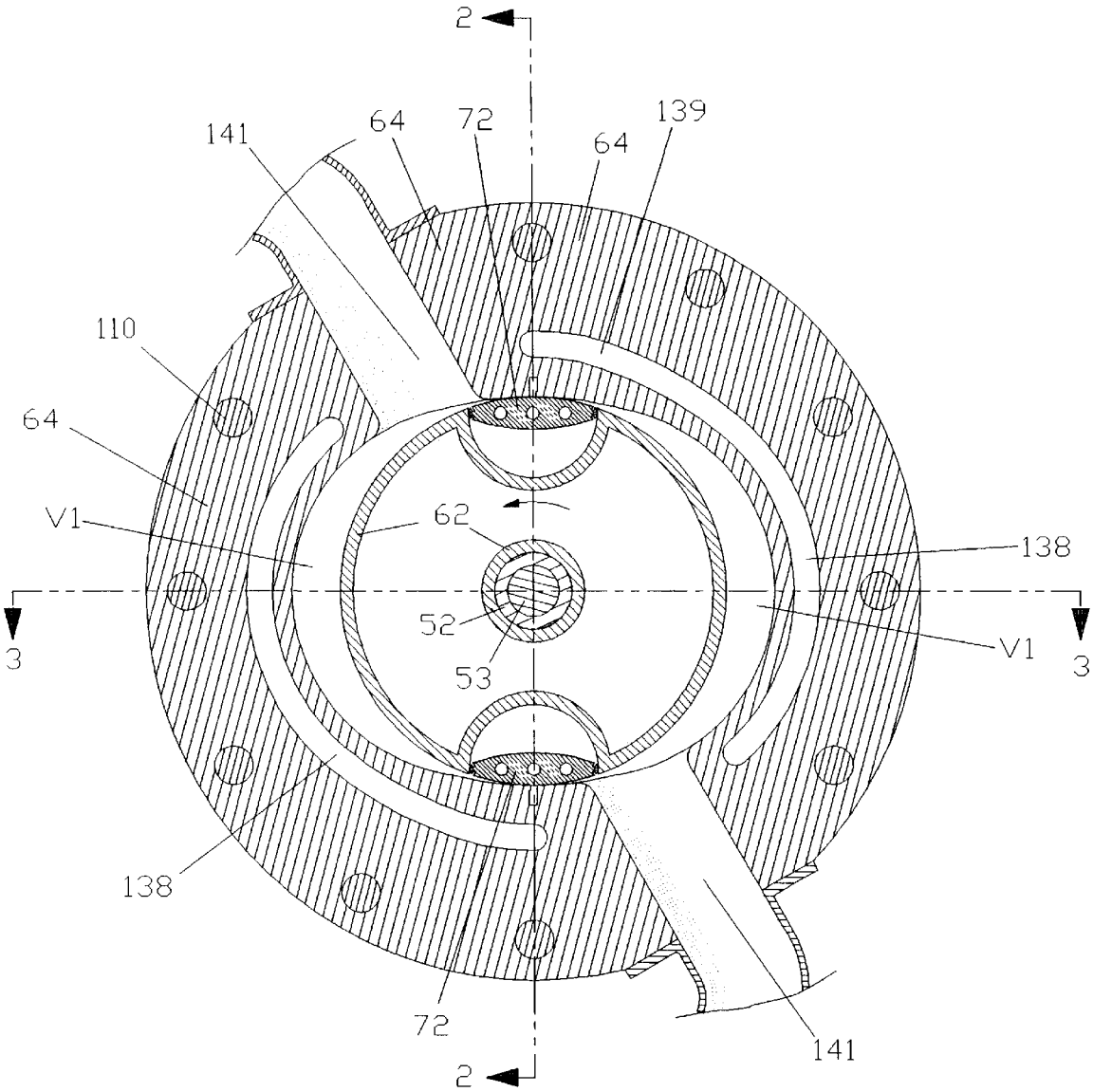
FIG. 4 Cross sectional view of compression stage taken through line 4—4 of FIG. 2
Figure 5:
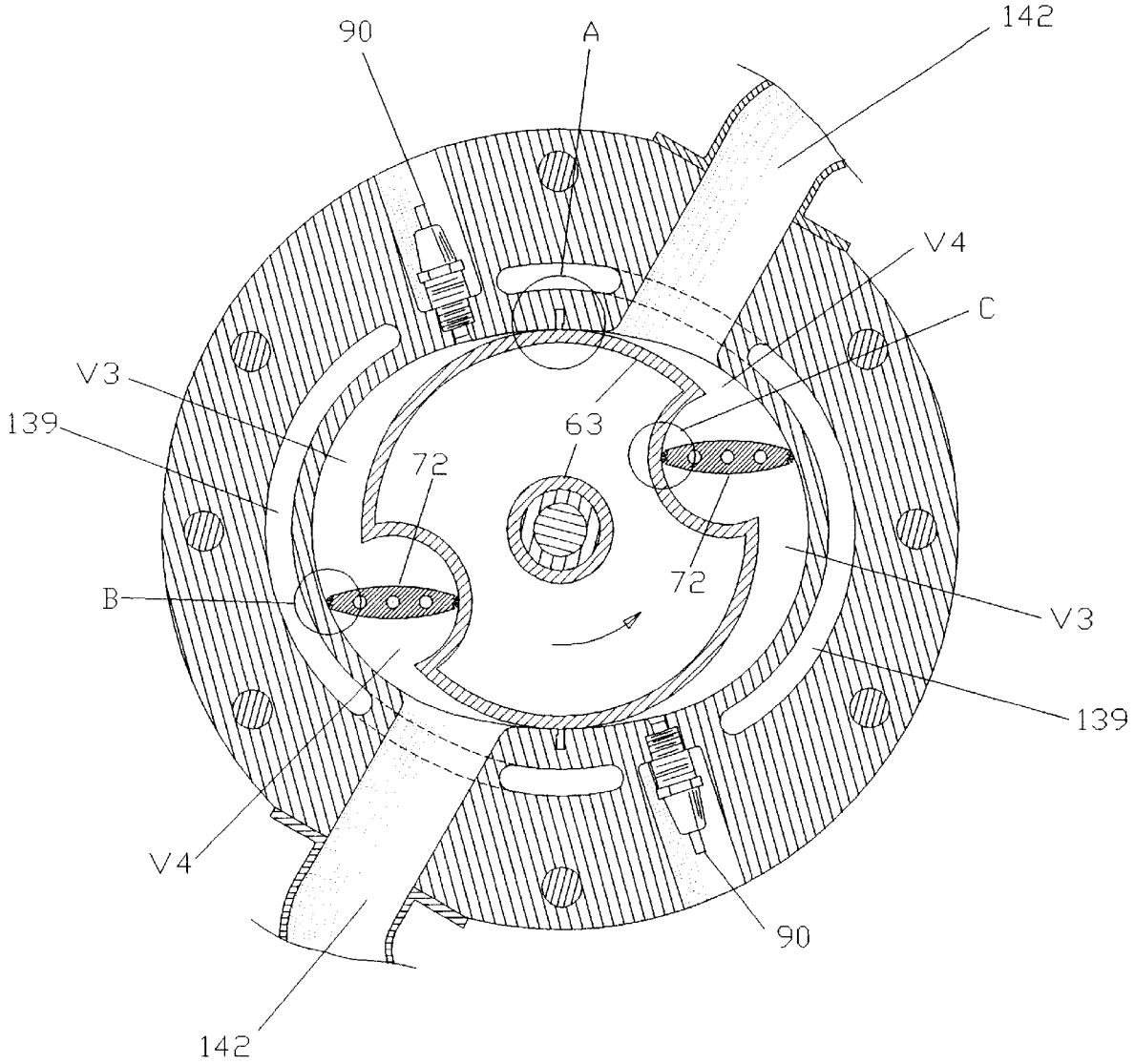
FIG. 5 Cross sectional view of combustion stage taken through line 5—5 of FIG. 2
Figure 7:
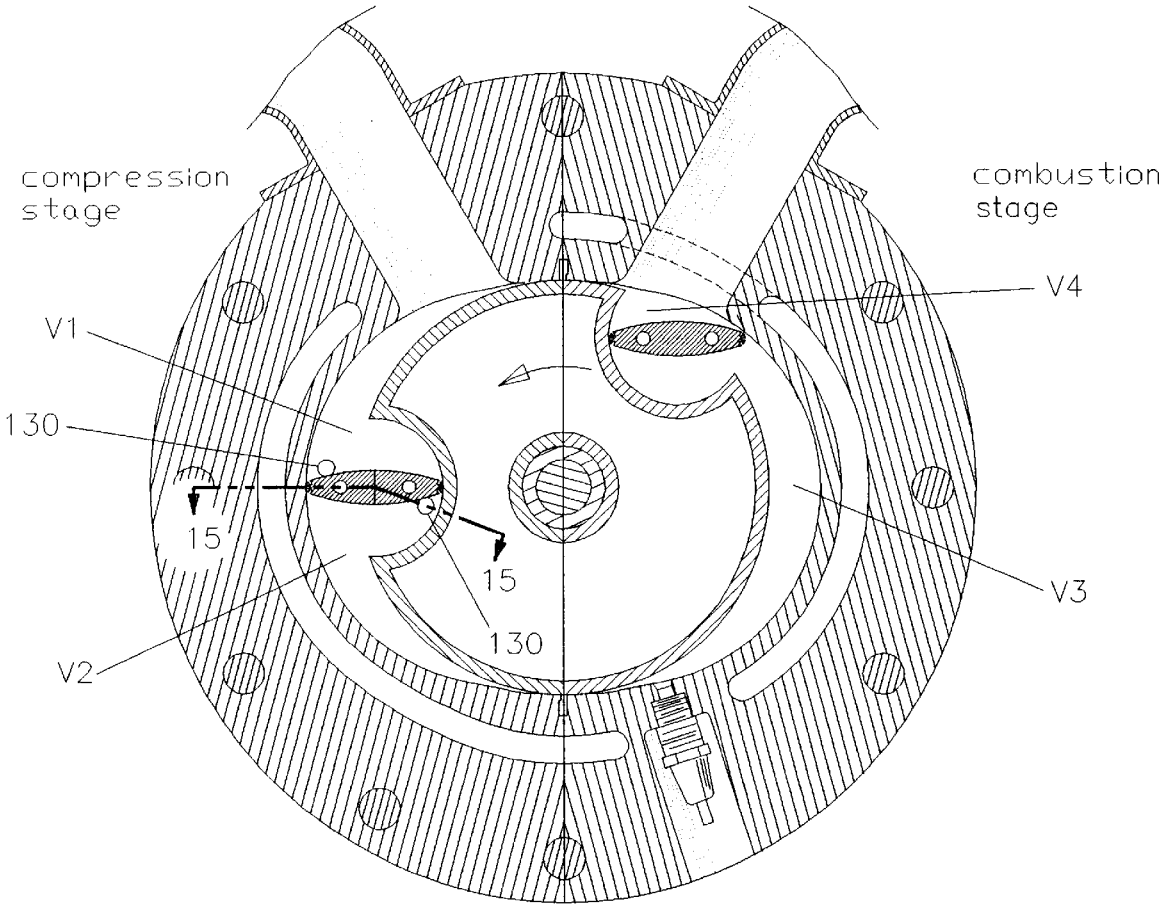
Figure 8:
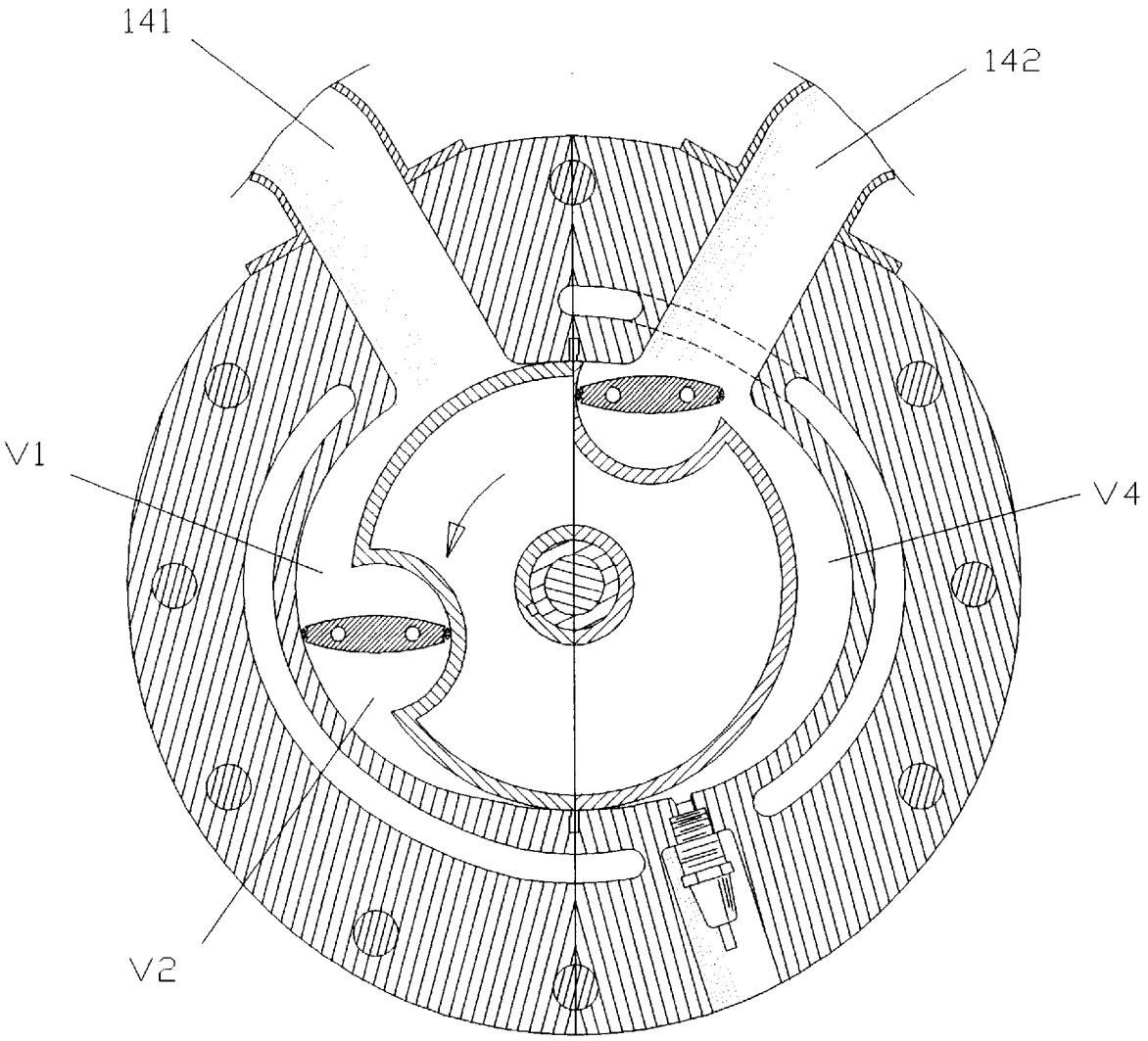
Figure 10:
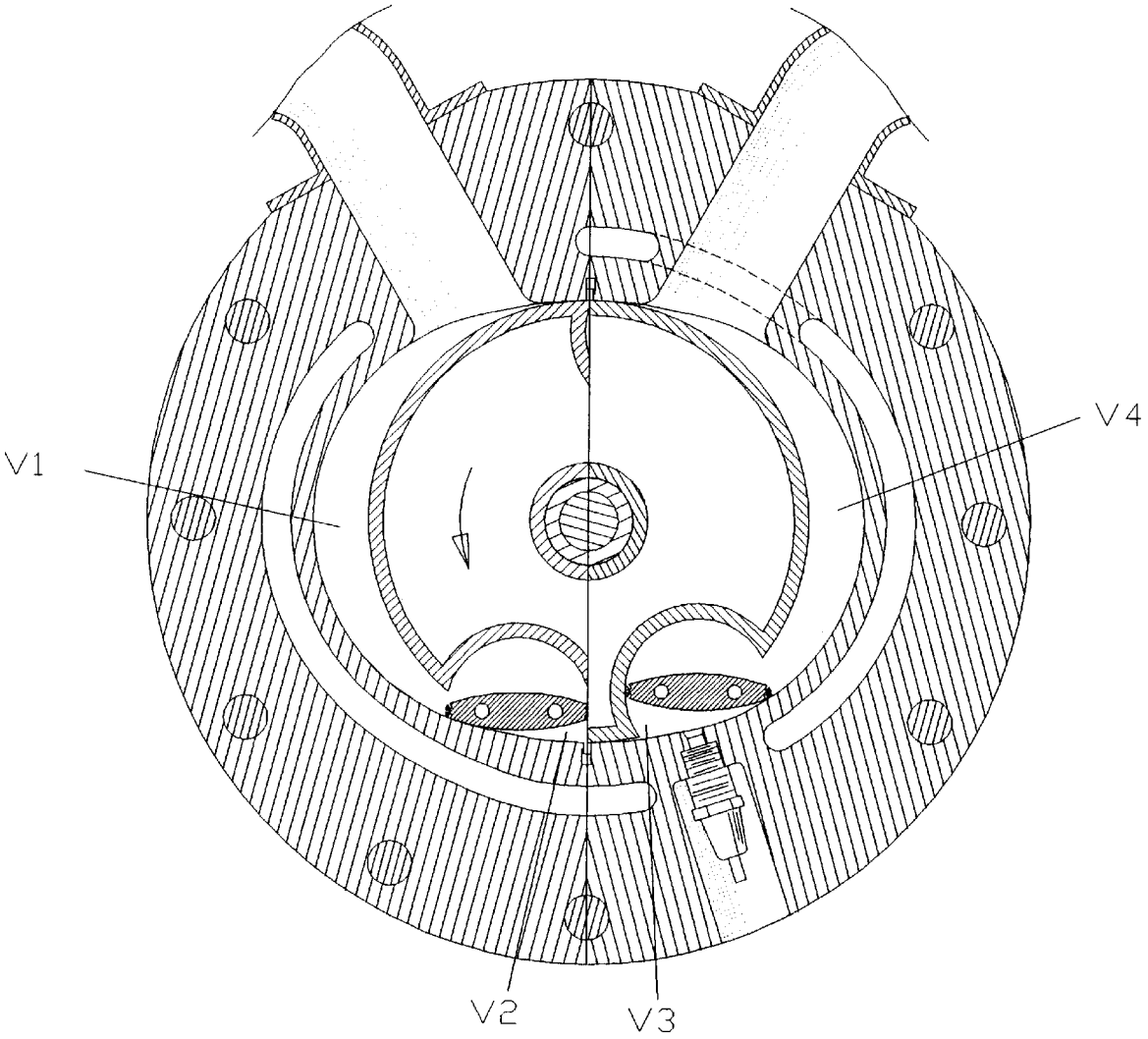
Figure 11:
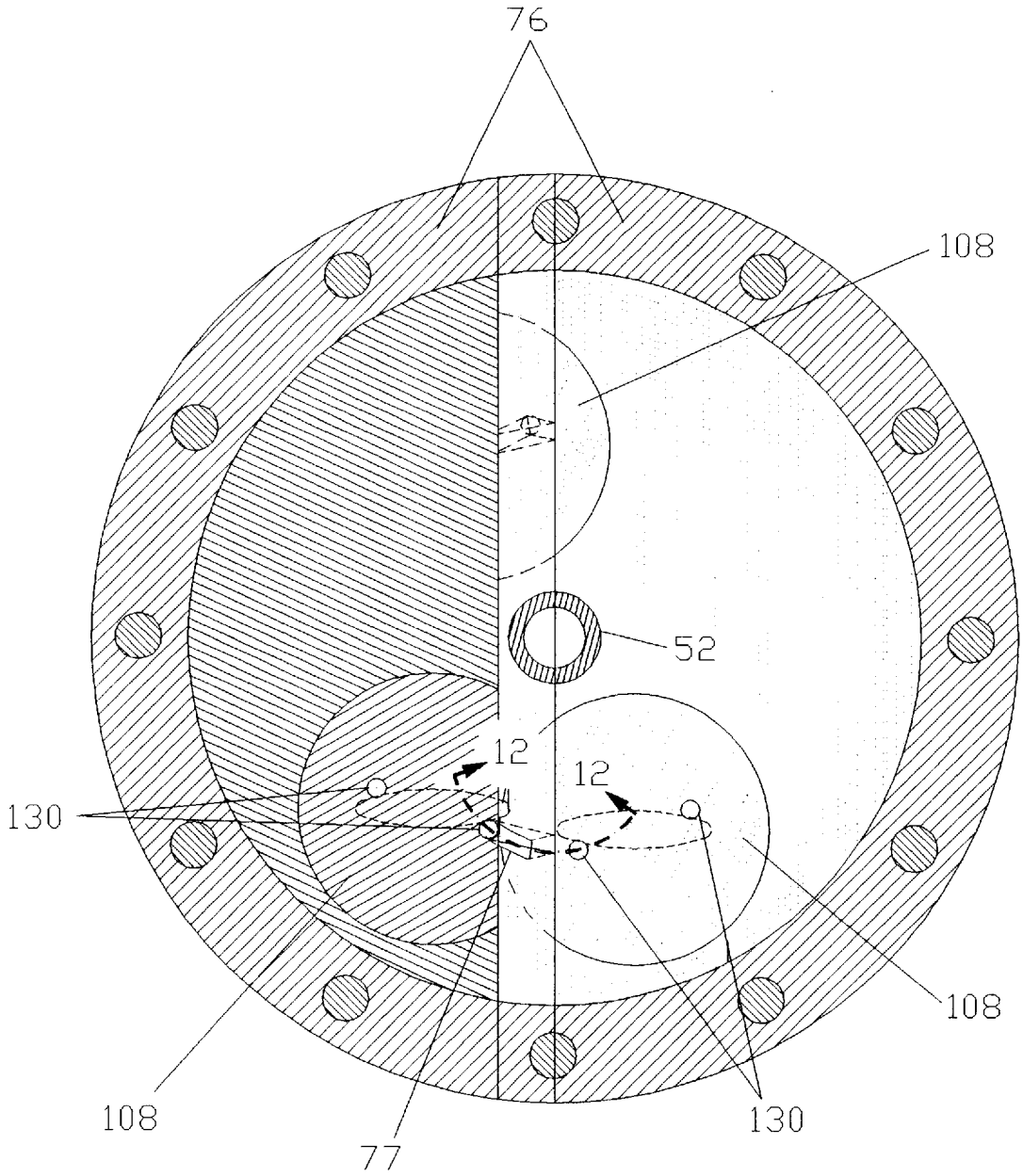
Figure 12:
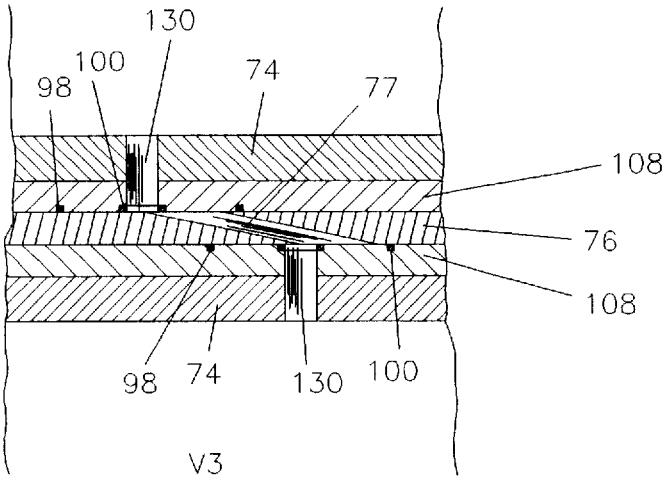

FIG. 4 shows the compression stage of the engine at the end of the intake cycle with an uncompressed fuel-air charge in variable volume chambers V1. FIG. 5 shows the combustion stage of the engine in mid stroke. FIGS. 6 through 10 show the sequence of events in the operating cycle of the engine. These figures show a section of the engine on line 6—6 of FIG. 3 with the compression stage of the engine on the left of center and the combustion stage on the right. Each of these figures show the relative position of the rotors and pistons of each stage at a given point in time. FIG. 6 shows that as the engine rotates pistons 72 in the compression chamber close off communication of the freshly inducted charge with intake ports 141 and enclose the charge in variable volume chambers V2. FIG. 7 shows that further engine rotation compresses the charge in variable volume chambers V2 and draws in a fresh charge in newly formed variable volume chambers V1. FIG. 8 shows the position of the engine at mid compression and at the beginning of the exhaust of the burned gases in V4. FIG. 9 shows the position of engine components at the end of the compression stroke and the start of the transfer of the compressed fuel air mixture to V3. FIG. 11 shows a sectional view of the engine at this position on line 11—11 of FIG. 3 and FIG. 12 is a cross sectional view on line 12—12 of FIG. 11 showing that ports 130 are just coming into alignment with valve passages 77 that pass obliquely through valve disk 76. At this point in the rotation of the engine, compression ends and flow of the compressed air-fuel mixture from variable volume chambers V2 into variable volume combustion chambers V3 begins through ports 130 and valve passages 77.

The flow from chambers V2 to V3 is essentially a constant pressure transfer of the compressed air-fuel mixture since the continued decrease in the volume of V2 with continuing engine rotation is accompanied by a corresponding increase in the volume of V3. Flow continues until the engine rotates into the position shown in FIGS. 10, 13 and 14 where ports 130 and 77 move out of alignment and flow through ports 130 ceases. At or near the end of the transfer of the air-fuel mixture to chambers V3 spark plugs 90 mounted in recesses communicating with said chambers are fired by means not shown (FIG. 10). Firing of the spark plugs ignites the air-fuel mixture in chambers V3. Combustion of the air-fuel mixture increases the pressure in chambers V3. The resulting forcible expansion of the gases against the piston surfaces in contact with said chambers transmits force from the piston, through the piston bearing plates and the rotor end plates to rotor 63 and the engine shaft. The volume in chambers V3 increases as shown in FIGS. 6 and 7 as the engine rotates. When the engine rotates to the position shown in FIG. 8 the gases burned in chambers V3 come into communication with exhaust ports 142 and the exhaust cycle of the engine for the gases just burned begins. The designation of the variable volume chamber containing combusted gases changes from V3 (combustion chamber) to V4 (exhaust chamber) when the chamber begins communication with exhaust ports 142. FIG. 6 shows that continued rotation of the engine clears combusted gases from the engine through the exhaust ports as the volume of chambers V4 is reduced.

As pistons in the compression stage and the combustion stage rotate to the positions show in FIG. 4 their trailing edges, for counterclockwise rotation as shown, transfer from sealed contact with one side of the elliptical chambers of the compression and combustion housings to sealed contact with the surface of the cylindrical openings in the rotors that accommodate the pistons. The leading edges of the pistons similarly "jump" from the rotors to the sides of the housing chambers. Longitudinal piston seal strips 114 shown in FIGS. 5, 15, 18, 21 and 22 minimize gas leakage between the piston edges and the inner surfaces the compression and combustion housings. Three seal strips are used on each edge of the piston. One or two strips are in contact with the sides of the housing chambers at any one time depending on the angle of the piston axis with the chamber wall. The ends of the seal strips are held as shown in FIG. 15 so that the strips stay in place in the pistons. The radii of the cylindrical openings in the rotors is slightly larger at their mouth so that as the piston edges rotate into the openings the seal strips do not catch on the edges of the openings.

Figure 26:
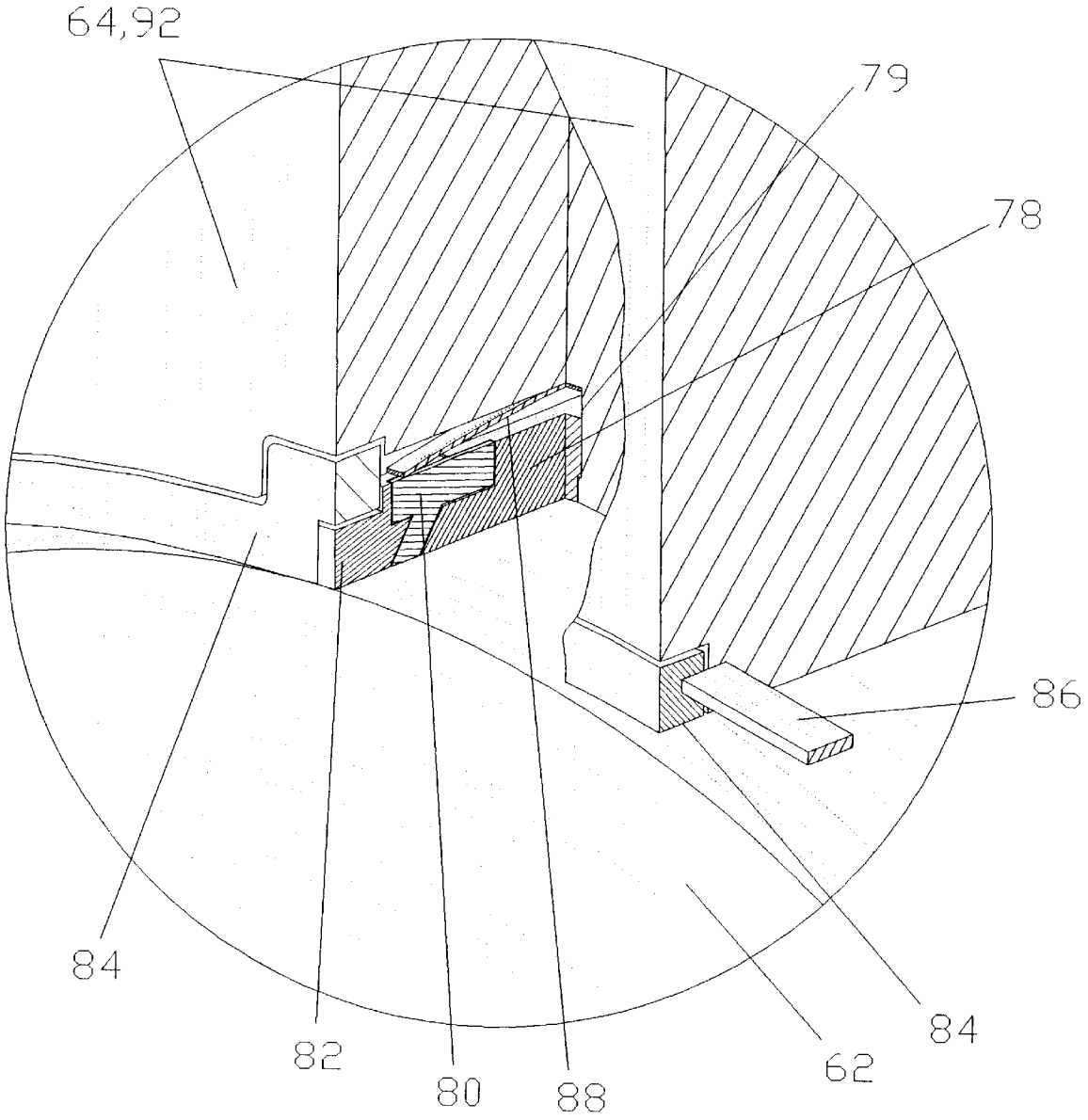
FIG. 26 Oblique cross section of housing to rotor seal end detail

A system of seals is used in the engine to minimize leakage of the air-fuel mire from variable volume chambers V2 during compression. A similar system is used to minimize leakage of the combusting air-fuel mixture from variable volume chambers V3. Seals are also used to minimize leakage of the compressed air-fuel mixture as it is transferred through the above described ports 130 from chambers V2 to V3. FIGS. 5, 19, 20, 23 and 25 show a sealing arrangement comprising housing to rotor seals 78, housing to rotor end seals 82, housing to rotor slip joint leaves 80 and housing to rotor seal springs 88. These components fit into sealing slots 66 that extend the length of compression and combustion housings 64 and 92, respectively, at the minor axes of the elliptically shaped openings in the housings as shown in FIGS. 19, 20 and 26. During rotation of the engine pressure from the compressed or combusting gases as well as the pressure of springs 88 forces seals 78 and 82 against rotors 62 thus minimizing leakage along the length of the rotors and the housings where they are closest to each other. A step in the profile of slots 66 and corresponding steps in the profiles of seals 78 and 82 retain the seals in the slots as the pistons 72 rotate past the slots. Housing to rotor slip joint leaves 80 shown in FIGS. 25 and 26 minimize leakage in the gap between seals 78 and 82. Said gap accommodates dimensional variation due to changes in temperature, etc.

Housing end seals 84 are located in recesses cut into housings 64 and 92 at each end of the elliptical openings in the housings as shown in FIGS. 3, 23, 24 and 25. Gas pressure presses the housing end seals 84 against end plates 60 and 68 and piston bearing plates 56 and 74. FIGS. 23 and 26 show that housing end seals 84 are notched to accommodate housing to rotor end seals 82. Housing end seal strips 86 shown in FIGS. 23, 24 and 26 restrict gas leakage between housing end seals 84 and housings 64 and 92. Housing to rotor seal springs 88 assure that contact is maintained between seals 82 and 78 and rotors 62. The arrangement of seals described above minmizes leakage of pressurized gases from the variable volume chambers.

Figure 14:
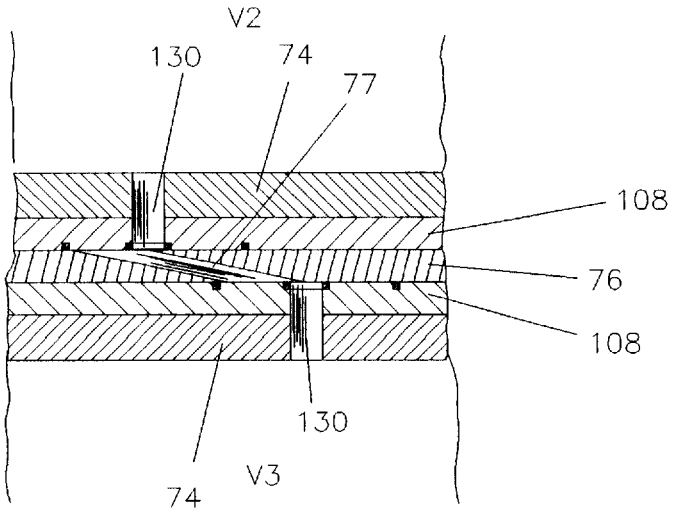
Figure 13:
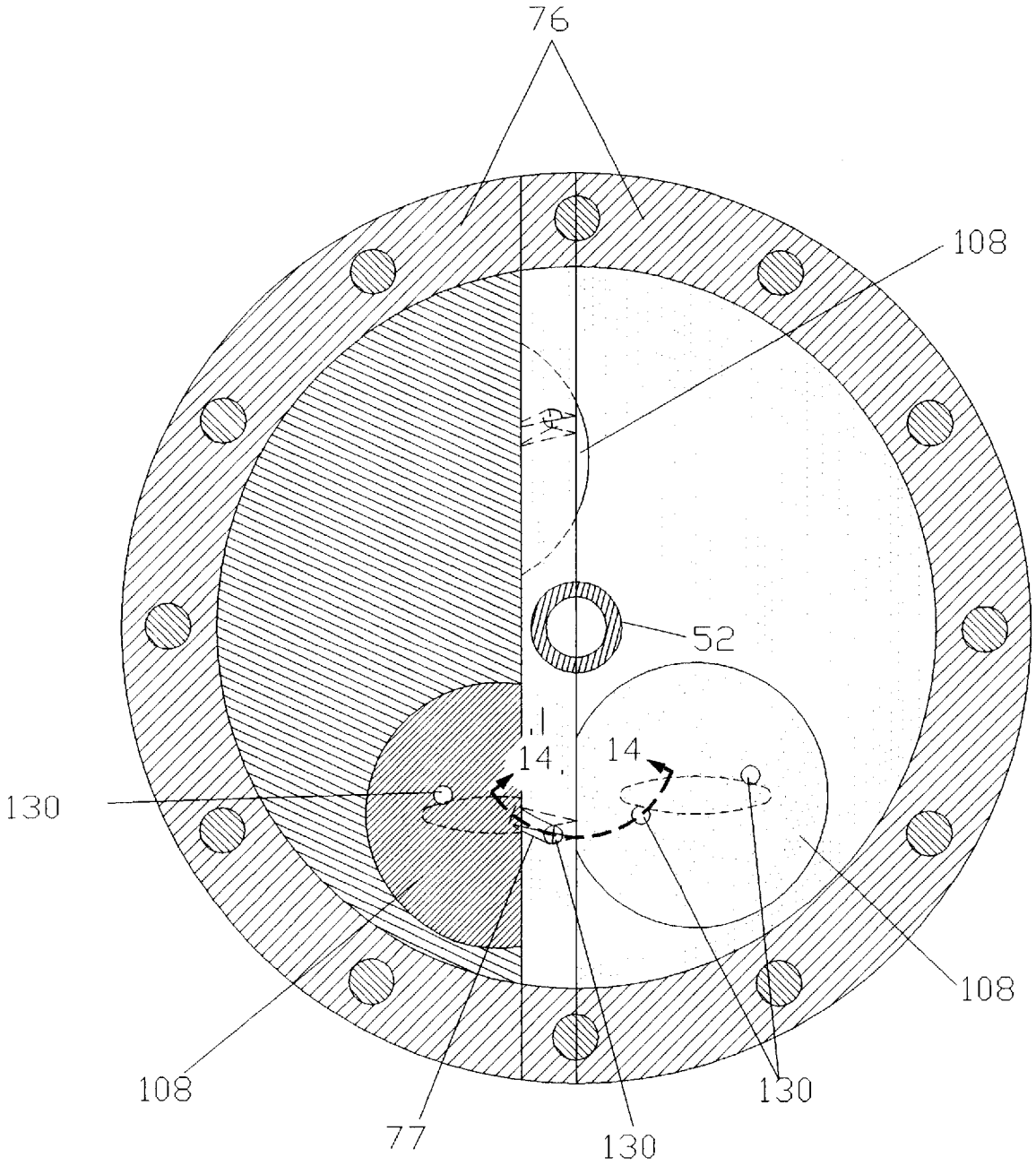

Ring seals 98 and 100 are retained in recesses cut in piston bearing end plates 108 that are concentric with ports 130 at the interface between valve 76 and the piston bearing end plates 108 as shown in FIGS. 12, 14 and 18. These ring seals minimize gas leakage through ports 130 when the ports are not aligned with passages 77.

In the preferred embodiment, coolant is pumped into one end of shaft 52 and through ports 134 that carry the coolant through cavities in rotors 62 and out the other end of the shaft (FIG. 2). Shaft plugs 53 block coolant from flowing directly through the shaft. Also, coolant is circulated by means not show through cavities 138 and 139 (FIGS. 2, 3, 4 and 5 ) in compression housing 64 and combustion housing 92, respectively. Air cooling of the engine is possible in an alternate embodiment (not shown) if appropriate cooling fins are attached to the exterior of the engine.

The compression ratio of the engine varies inversely with the angular displacement between the compression rotor and the combustion rotor.

Figure 28:
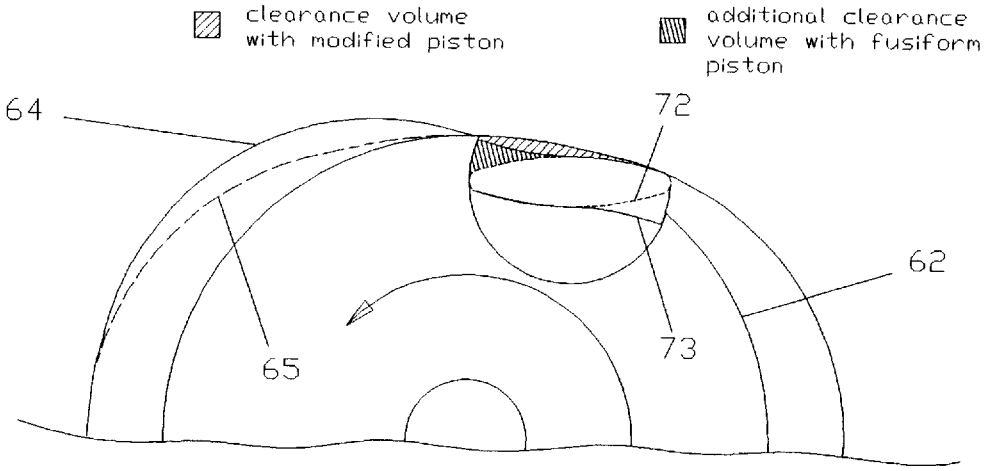

FIG. 27 shows a sectional view similar to FIG. 4 of the compression stage of an alternate embodiment of the engine utilizing pistons 73 and compression housing 65 that are shaped to minimize the lost or clearance volume of gases compressed but not transferred to the combustion stage when transfer passages close. In FIG. 28 the sum of the shaded areas X and Y represent the cross section of the volume of gases compressed in variable volume chambers V2 at the end of the transfer of compressed gases from V2 to variable volume chambers V3. This volume of gases is lost when the leading edge of the cylindrical recesses in the rotor rotate past the rotor to housing seals. Reducing the amount of "lost" gases increases engine efficiency. When pistons 73 and and compression housings 65 and correspondingly shaped combustion chambers not shown are used the lost gases are reduced to the volume of gases represented by shaded area X in FIG. 28.

Figure 29:
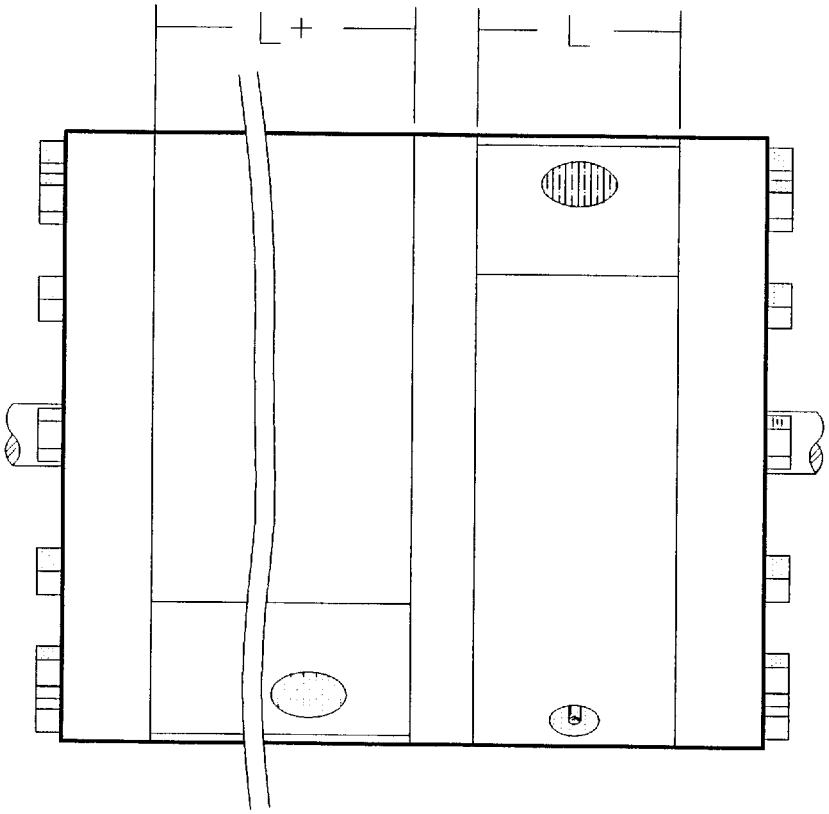

FIG. 29 shows that alternate embodiments of the engine can use a compression stage that is axially longer than the combustion stage in order to achieve supercharging or increased compression.

Figure 30:
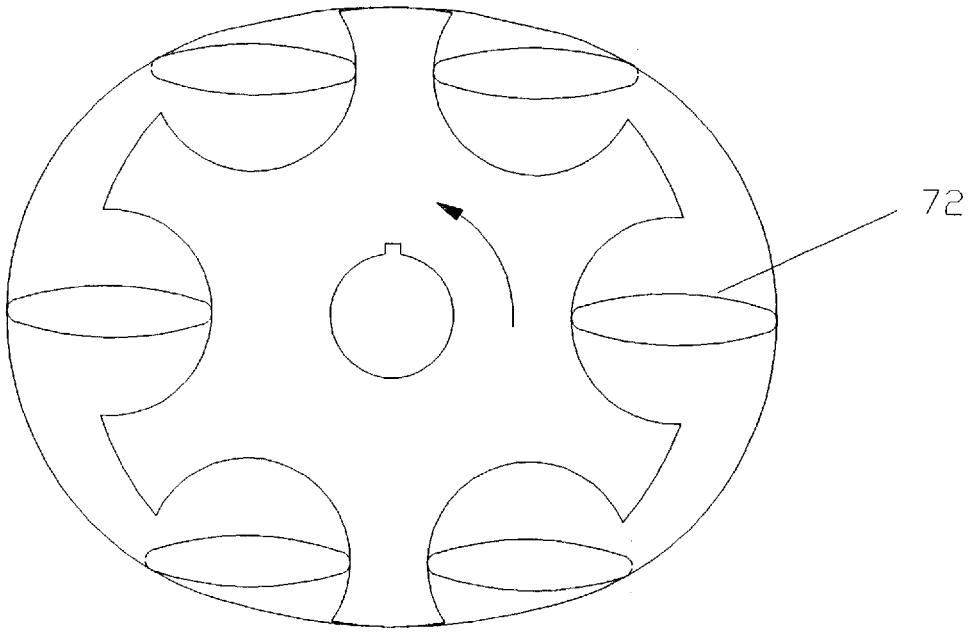

FIG. 30 shows that more than two pistons can be used in the compression and combustion stages of the engine, although the number of pistons must be the same in both stages of a given engine.

SUMMARY, RAMIFICATIONS AND SCOPE

Accordingly, the reader will see that this rotary engine combines the advantages of the reciprocating piston engine with those of gas turbine engines in that:

- as in reciprocating piston engines it permits the use of higher peak temperatures, and therefore higher thermodynamic efficiency, because combustion is intermittent;
- as in gas turbine engines the motion of components is rotary and avoids the inherent disadvantage of the reciprocating piston crank;
- it avoids the high shock loads of "cat and mouse" rotary engines;
- it does not require counterweights to balance eccentric components.

Although the description above contains many detailed specifications, these should not be construed as limitations of the scope of the invention but as illustrations of some of the currently preferred or simplified embodiments of this invention. For example, the pistons can be fisiform or nearly rectangular in cross section, the rotation of the pistons can be controlled by cams, gears or other means, carburetion or fuel injection can be used, various cooling means can be utilized, the angular displacement between compression and combustion rotors can be varied and the length of the compression stage can be varied.

Therefore, the scope of the invention should be determined by the appended claims and their legal equivalents, rather than by the examples given.

I claim:

1. A rotary engine comprising a cylindrical compression housing having at least two inlet ports and containing an opening approximately elliptical in cross section, a coaxial combustion housing having at least two exhaust ports and containing an opening approximately elliptical in cross section, means for mixing air and fuel, means in the combustion housing for igniting a gaseous mixture of air and fuel, a disk valve positioned between the housings having a plurality of openings passing through the valve, housing end plates attached to the ends of said compression and combustion housings opposite said disk valve, means to support the assembled housings, disk and end plates, a shaft concentric with the housings and mounted for rotation in bearings set in said end plates, a compression rotor attached to the shaft for rotation within the compression housing, a combustion rotor angularly displaced with respect to the compression rotor attached to the shaft for rotation within the combustion housing, said rotors having a plurality of longitudinal recesses to accommodate the orbital rotation about the shaft of a plurality of pistons, said pistons being fusiform in cross section and supported in bearings for rotation, outer end plates attached to the rotors at the outer ends of the compression and combustion housings, inner end plates attached to the rotors at the inner ends of the compression and combustion housings, piston bearings supported in said inner and outer end plates, said inner and outer plates providing means to transmit forces from the piston bearings to the rotors and thereby to the engine shaft, means for maintaining the attitude of the pistons during engine rotation so that during one half of each rotation one edge of each piston maintains sealed contact with the wall of one of the openings in the housings and the other edge of the piston maintains sealed contact with one of the rotors; a plurality of variable volume working chambers bounded by the interior walls of the elliptical opening in the compression housing, the outer surface of the compression rotor, one surface of said piston and the outer and inner plates attached to the compression rotor; a plurality of variable volume working chambers bounded by the interior walls of the elliptical opening in the combustion housing, the outer surface of the combustion rotor, one surface of said piston and the outer and inner plates attached to the combustion rotor, means for sealing said variable volume working chambers, a plurality of ports communicating with said variable volume working chambers and positioned to connect compression variable volume working chambers to combustion variable volume working chambers through said disk valve openings during a portion of engine rotation.

2. A rotary engine as claimed in claim 1, the compression housing and the rotor and pistons contained therein being longer than the combustion housing.

3. In a rotary engine as claimed in claim 1, means for sealing longitudinally between said rotors and said compression and combustion housings.

4. In a rotary engine as claimed in claim 1, means for sealing between said compression and combustion housings and said inner and outer end plates.

5. In a rotary engine as claimed in claim 1, means for sealing longitudinally between said piston edges, the walls of said compression and combustion housings and said rotors.

6. In a rotary engine as claimed in claim 1, means of sealing ports communicating with said variable volume working chambers during a portion of engine rotation.

7. In a rotary engine as claimed in claim 1, means to prevent leakage of compressed air and fuel flowing between said variable volume working chambers through said ports and openings in said disk valve.

8. A rotary engine comprising a cylindrical compression housing having at least two inlet ports and containing an opening that in cross section contains two lobes and is oblong, a coaxial combustion housing having at least two exhaust ports and containing an opening that in cross section contains two lobes and is oblong, means for mixing air and fuel, means in the combustion housing for igniting a gaseous mixture of air and fuel, a disk valve positioned between the housings having a plurality of openings passing through the valve, housing end plates attached to the ends of said compression and combustion housings opposite said disk valve, means to support the assembled housings, disk and end plates, a shaft concentric with the housings and mounted for rotation in bearings set in said end plates, a compression rotor attached to the shaft for rotation within the compression housing, a combustion rotor angularly displaced with respect to the compression rotor attached to the shaft for rotation within the combustion housing, said rotors having a plurality of longitudinal recesses to accommodate the orbital rotation about the shaft of a plurality of pistons, said pistons being approximately rectangular in cross section and supported in bearings for rotation, outer end plates attached to the rotors at the outer ends of the compression and combustion housings, inner end plates attached to the rotors at the inner ends of the compression and combustion housings, piston bearings supported in said inner and outer end plates, said inner and outer plates providing means to transmit forces from the piston bearings to the rotors and thereby to the engine shaft, means for maintaining the attitude of the pistons during engine rotation so that during one half of each rotation one edge of each piston maintains sealed contact with the wall of one of the openings in the housings and the other edge of the piston maintains sealed contact with one of the rotors; a plurality of variable volume working chambers bounded by the interior walls of the opening in the compression housing, the outer surface of the compression rotor, one surface of said piston and the outer and inner plates attached to the compression rotor; a plurality of variable volume working chambers bounded by the interior walls of the opening in the combustion housing, the outer surface of the combustion rotor, one surface of said piston and the outer and inner plates attached to the combustion rotor, means for sealing said variable volume working chambers, a plurality of ports communicating with said variable volume working chambers and positioned to connect compression variable volume working chambers to combustion variable volume working chambers through said disk valve openings during a portion of engine rotation.

* * * * *